US012163310B2

(12) United States Patent
Sano et al.

(10) Patent No.: US 12,163,310 B2
(45) Date of Patent: Dec. 10, 2024

(54) SHOVEL PERFORMING COMPACTION BY AUTOMATICALLY MOVING ARM AND END ATTACHMENT ACCORDING TO BOOM LOWERING OPERATION

(71) Applicant: SUMITOMO HEAVY INDUSTRIES, LTD., Tokyo (JP)

(72) Inventors: Yusuke Sano, Kanagawa (JP); Chunnan Wu, Kanagawa (JP); Kazunori Hiranuma, Kanagawa (JP); Junichi Morita, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1074 days.

(21) Appl. No.: 17/034,544

(22) Filed: Sep. 28, 2020

(65) Prior Publication Data

US 2021/0010229 A1 Jan. 14, 2021

Related U.S. Application Data

(63) Continuation of application No. PCT/JP2019/014545, filed on Apr. 1, 2019.

(30) Foreign Application Priority Data

Mar. 31, 2018 (JP) ..... 2018-070462

(51) Int. Cl.
*E02F 3/96* (2006.01)
*E02F 3/43* (2006.01)
*E02F 9/26* (2006.01)

(52) U.S. Cl.
CPC ..... *E02F 3/967* (2013.01); *E02F 3/437* (2013.01); *E02F 9/265* (2013.01)

(58) Field of Classification Search
None
See application file for complete search history.

(56) References Cited

U.S. PATENT DOCUMENTS 5,826,666 A 10/1998 Tozawa et al.
5,903,988 A 5/1999 Tochizawa et al.
(Continued)

FOREIGN PATENT DOCUMENTS

JP H07-180173 7/1995
JP H07-305375 11/1995
(Continued)

OTHER PUBLICATIONS

International Search Report for PCT/JP2019/014545 mailed on Jul. 2, 2019.

*Primary Examiner* — James J Lee
*Assistant Examiner* — Jonathan E Reinert
(74) *Attorney, Agent, or Firm* — IPUSA, PLLC

(57) ABSTRACT

A shovel includes a lower traveling body, an upper turning body turnably mounted on the lower traveling body, a boom attached to the upper turning body, an arm attached to the boom, an end attachment attached to the arm, a sensor configured to output detection information about an orientation of a work part of the end attachment, and a processor configured to control operation of the work part to cause the work part to perform compaction of ground by pressing the work part against the ground, wherein the processor is configured to control an operation of the arm and the end attachment according to a lowering operation of the boom to cause an end portion of the work part to perform the compaction of the ground on the basis of the detection information of the sensor.

17 Claims, 18 Drawing Sheets

(56) References Cited

U.S. PATENT DOCUMENTS

| | | | | |
|---|---|---|---|---|
| 7,610,136 | B2 | 10/2009 | Okamura et al. | |
| 2017/0284070 | A1* | 10/2017 | Matsuyama | E02F 9/2292 |
| 2019/0390436 | A1* | 12/2019 | Tanaka | E02F 9/2033 |
| 2021/0040705 | A1* | 2/2021 | Ishihara | E02F 3/435 |

FOREIGN PATENT DOCUMENTS

| | | |
|---|---|---|
| JP | H08-060711 | 3/1996 |
| JP | H09-228404 | 9/1997 |
| JP | 2008-106440 | 5/2008 |
| JP | 2010-121441 | 6/2010 |
| JP | 2019-060109 | 4/2019 |

* cited by examiner

SHOVEL PERFORMING COMPACTION BY AUTOMATICALLY MOVING ARM AND END ATTACHMENT ACCORDING TO BOOM LOWERING OPERATION

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2019/014545, filed on Apr. 1, 2019, and designating the U.S., which claims priority to Japanese patent application No. 2018-070462, filed on Mar. 31, 2018. The entire contents of the foregoing applications are incorporated herein by reference.

BACKGROUND

Technical Field

The present disclosure relates to a shovel.

Description of Related Art

For example, a construction machine that controls the compaction force during leveling work and slope finishing work by controlling the attachment so as to cause the cylinder pressure to attain a predetermined value has been disclosed.

SUMMARY

According to an aspect of the present disclosure, a shovel includes a lower traveling body, an upper turning body turnably mounted on the lower traveling body, a boom attached to the upper turning body, an arm attached to the boom, an end attachment attached to the arm, a sensor configured to output detection information about an orientation of a work part of the end attachment, and a processor configured to control operation of the work part to cause the work part to perform compaction of ground by pressing the work part against the ground, wherein the processor is configured to control an operation of the arm and the end attachment according to a lowering operation of the boom to cause an end portion of the work part to perform the compaction of the ground on the basis of the detection information of the sensor.

EMBODIMENT OF THE INVENTION

Hereinafter, an embodiment for carrying out the present invention is described with reference to drawings.

A construction machine controls the compaction force during leveling work and slope finishing work by controlling the attachment so as to cause the cylinder pressure to attain a predetermined value. However, although a pressing force applied from a work part (for example, a back surface of a bucket) to the ground is different depending on the pose of the work part, the pose of the work part is not taken into consideration. Therefore, with respect to the compaction work in which the ground is required to be pressed with a certain level or higher compaction force, scope of improvement is associated with the accuracy of the compaction force in order to finish the ground with a better quality.

Accordingly, in view of the above problems, it is desired to provide a shovel capable of finishing the ground with a higher accuracy in compaction work.

[Overview of Shovel]

First, overview of a shovel 100 according to the present embodiment is hereinafter explained with reference to FIG. 1.

Figure 1:
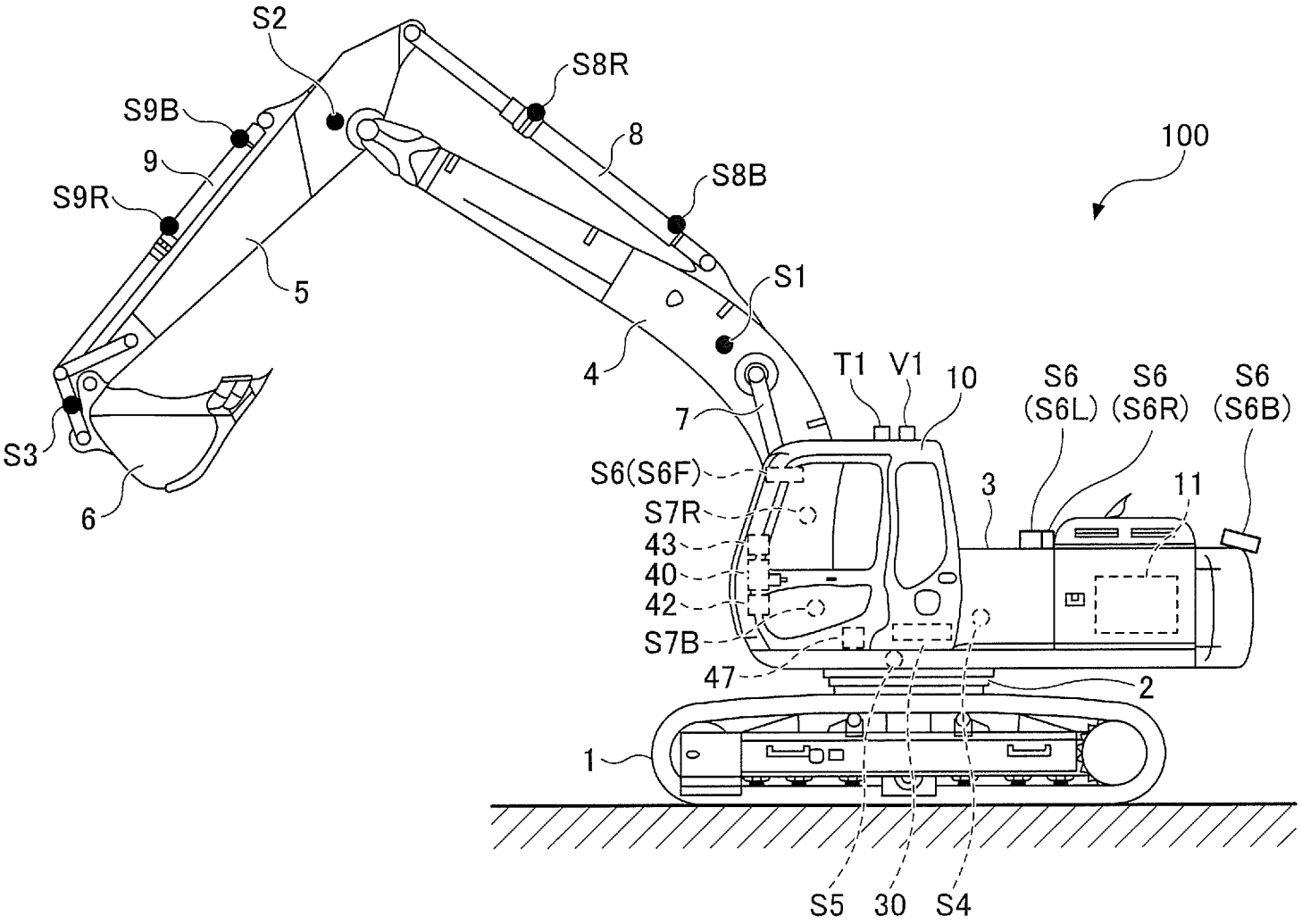
FIG. 1 is a side view of a shovel.

FIG. 1 is a side view of a shovel 100 (i.e., an excavator) according to the present embodiment.

The shovel 100 according to the present embodiment includes a lower traveling body 1, an upper turning body 3 turnably mounted on the lower traveling body 1 with a turning mechanism 2, a boom 4, an arm 5, a bucket 6, and a cab 10. The boom 4, the arm 5, and the bucket 6 constitute an attachment.

The lower traveling body 1 (an example of a travelling body) may include, for example, a pair of right and left crawlers. The crawlers are hydraulically driven by travelling hydraulic motors 1L, 1R (see FIG. 2) to cause the shovel 100 to travel.

The upper turning body 3 (an example of a turning body) is driven by a turning hydraulic motor 2A (see FIG. 2 explained later) to turn with respect to the lower traveling body 1.

The boom 4 is pivotally attached to the front center of the upper turning body 3 to be able to vertically pivot. The arm 5 is pivotally attached to the end of the boom 4 to be able to pivot vertically. The bucket 6 is pivotally attached to the end of the arm 5 to be able to pivot vertically. The boom 4, the arm 5, and the bucket 6 (each of which is an example of a link unit) are hydraulically driven by a boom cylinder 7, an arm cylinder 8, and a bucket cylinder 9, respectively, serving as hydraulic actuators.

The cab 10 is an operation room in which the operator rides, and is mounted on the front left of the upper turning body 3.

[Configuration of Shovel]

Next, a specific configuration of the shovel 100 according to the present embodiment is explained with reference to not only FIG. 1 but also FIG. 2.

Figure 2:
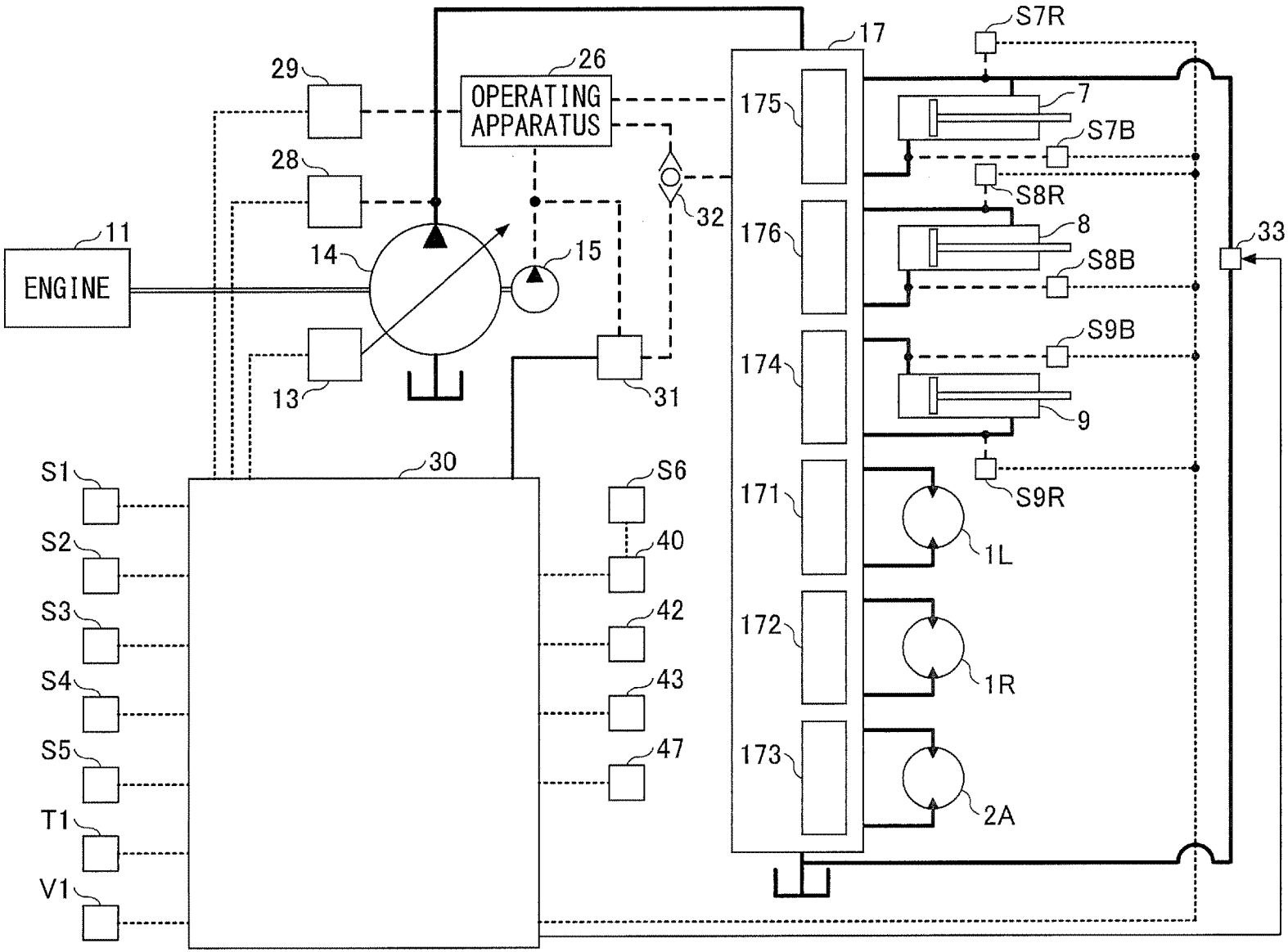
FIG. 2 is a block diagram illustrating an example of a configuration of the shovel.

FIG. 2 is a drawing of an example of configuration of the shovel 100 according to the present embodiment.

In FIG. 2, a mechanical power line, a high-pressure hydraulic line, a pilot line, and an electric drive and control system are indicated by a double line, a thick solid line, a dashed line, and a thin solid line, respectively. This is also applicable to FIG. 3 and FIGS. 4A to 4C to be explained later.

The drive system of the shovel 100 according to the present embodiment for hydraulically driving a hydraulic actuator includes an engine 11, a regulator 13, a main pump 14, and a control valve unit 17. As described above, the hydraulic drive system of the shovel 100 according to the present embodiment includes hydraulic actuators such as the traveling hydraulic motors 1L, 1R, the turning hydraulic motor 2A, the boom cylinder 7, the arm cylinder 8, and the bucket cylinder 9, which hydraulically drive the lower traveling body 1, the upper turning body 3, the boom 4, the arm 5, and the bucket 6, respectively.

The engine 11 is a main power source in the hydraulic drive system, and is mounted on the rear part of the upper turning body 3, for example. Specifically, under direct or indirect control by a controller 30 explained later, the engine 11 rotates constantly at a preset target rotational speed, and drives the main pump 14 and a pilot pump 15. The engine 11 is, for example, a diesel engine using light oil as fuel.

The regulator 13 controls the amount of discharge of the main pump 14. For example, the regulator 13 adjusts the angle (tilt angle) of a swashplate of the main pump 14 in accordance with a control instruction given by the controller 30. For example, as explained above, the regulator 13 includes regulators 13L, 13R.

The main pump 14 is mounted, for example, on the rear part of the upper turning body 3, like the engine 11, and supplies hydraulic oil to the control valve unit 17 through a high-pressure hydraulic line. The main pump 14 is driven by the engine 11 as described above. The main pump 14 is, for example, a variable displacement hydraulic pump, in which the regulator 13 controls the tilt angle of the swashplate to adjust the stroke length of a piston under the control performed by the controller 30 as described above, so that the discharge flowrate (discharge pressure) can be controlled. For example, the main pump 14 includes main pumps 14L, 14R as explained later.

The control valve unit 17 is a hydraulic control device that is installed, for example, at the center of the upper turning body 3, and that controls the hydraulic drive system in accordance with an operator's operation of an operating apparatus 26. The control valve unit 17 is connected to the main pump 14 via the high-pressure hydraulic line as described above, and hydraulic oil supplied from the main pump 14 is selectively supplied to the hydraulic actuators (i.e., the traveling hydraulic motors 1L, 1R, the turning hydraulic motor 2A, the boom cylinder 7, the arm cylinder 8, and the bucket cylinder 9) according to the operating state of the operating apparatus 26. Specifically, the control valve unit 17 includes control valves 171 to 176 that control the flowrates and the flow directions of hydraulic oil supplied from the main pump 14 to the respective hydraulic actuators. Specifically, the control valve 171 corresponds to the traveling hydraulic motor 1L, the control valve 172 corresponds to the traveling hydraulic motor 1R, and the control valve 173 corresponds to the turning hydraulic motor 2A. The control valve 174 corresponds to the bucket cylinder 9, the control valve 175 corresponds to the boom cylinder 7, and the control valve 176 corresponds to the arm cylinder 8. Also, for example, as explained later, the control valve 175 includes control valves 175L, 175R, and for example, as explained later, the control valve 176 includes control valves 176L, 176R. The details of the control valves 171 to 176 are explained later (see FIG. 3).

The operation system of the shovel 100 according to the present embodiment includes the pilot pump 15 and an operating apparatus 26. The operation system of the shovel 100 includes a shuttle valve 32 as a configuration relating to the automatic control function performed by the controller 30 explained later.

The pilot pump 15 is installed, for example, on the rear part of the upper turning body 3, and applies a pilot pressure to the operating apparatus 26 via a pilot line 25. For example, the pilot pump 15 is a fixed displacement hydraulic pump, and is driven by the engine 11, as described above.

The operating apparatus 26 is provided near the operator's seat of the cab 10, and is an operation input means allowing the operator to operate the operational elements (such as the lower traveling body 1, the upper turning body 3, the boom 4, the arm 5, the bucket 6, and the like). In other words, the operating apparatus 26 is an operation input means for operating the hydraulic actuators (such as the traveling hydraulic motors 1L, 1R, the turning hydraulic motor 2A, the boom cylinder 7, the arm cylinder 8, and the bucket cylinder 9). The operating apparatus 26 is connected to the control valve unit 17 directly via a secondary-side pilot line or indirectly via a shuttle valve 32 explained later provided in a secondary-side pilot line. The control valve unit 17 receives a pilot pressure corresponding to the state of operation of the operating apparatus 26 for each of the lower traveling body 1, the upper turning body 3, the boom 4, the arm 5, the bucket 6, and the like. Accordingly, the control valve unit 17 can drive each of the hydraulic actuators in accordance with the state of operation of the operating apparatus 26. For example, the operating apparatus 26 includes lever devices 26A to 26C operating the boom 4 (the boom cylinder 7), the arm 5 (the arm cylinder 8), and the bucket 6 (the bucket cylinder 9), respectively (see FIG. 4). Also, for example, the operating apparatus 26 includes pedal devices for operating the left and right lower traveling body 1 (the travelling hydraulic motors 1L, 1R).

The shuttle valve 32 includes two inlet ports and one output port, and is configured to output, from the output port, hydraulic oil having a higher pilot pressure from among the pilot pressures applied to the two inlet ports. One of the two inlet ports of the shuttle valve 32 is connected to the operating apparatus 26, and the other inlet ports of the shuttle valve 32 is connected to the proportional valve 31. The output port of the shuttle valve 32 is connected to the pilot port of the corresponding control valve in the control valve unit 17 through the pilot line (for the details, see FIG. 4). Therefore, the shuttle valve 32 can apply one of the pilot pressure generated by the operating apparatus 26 and the pilot pressure generated by the proportional valve 31, whichever is higher, to the pilot port of the corresponding control valve. In other words, the controller 30 explained later outputs, from the proportional valve 31, a pilot pressure higher than the secondary-side pilot pressure output from the operating apparatus 26 to control the corresponding control valve regardless of the operation of the operating apparatus 26 by the operator. Therefore, the controller 30 can control the operation of various kinds of operation elements. For example, as explained later, the shuttle valve 32 includes shuttle valves 32AL, 32AR, 32BL, 32BR, 32CL, 32CR.

The control system of the shovel 100 according to the present embodiment includes a controller 30, a discharge pressure sensor 28, an operation pressure sensor 29, a proportional valve 31, a relief valve 33, a display device 40, an input device 42, a sound output device 43, a storage device 47, a boom angle sensor S1, an arm angle sensor S2, a bucket angle sensor S3, a shovel body inclination sensor S4, a turning state sensor S5, an image-capturing device S6, a boom rod pressure sensor S7R, a boom bottom pressure sensor S7B, an arm rod pressure sensor S8R, an arm bottom pressure sensor S8B, a bucket rod pressure sensor S9R, a bucket bottom pressure sensor S9B, a positioning device V1, and a communication device T1.

For example, the controller 30 (an example of a control device) is provided in the cab 10 to drive and control the shovel 100. The functions of the controller 30 may be achieved by any hardware or a combination of hardware and software. For example, the controller 30 is constituted by a microcomputer including a CPU (Central Processing Unit), ROM (Read Only Memory), RAM (Random Access Memory), a non-volatile auxiliary storage device, an I/O (Input-Output) interface, and the like. For example, the controller 30 achieves various functions by causing the CPU to execute various programs stored in the non-volatile auxiliary storage device.

For example, the controller 30 drives and controls the engine 11 at constant rotational speed by setting a target rotation speed on the basis of a work mode and the like, which are set in advance by an operator's operation and the like.

For example, as necessary, the controller 30 outputs a control instruction to the regulator 13 to change the amount of discharge of the main pump 14.

For example, the controller 30 controls a machine guidance function to guide the operator with respect to manual operation of the operating apparatus 26 for controlling the shovel 100. For example, the controller 30 controls a machine control function to automatically support the operator with respect to manual operation of the operating apparatus 26 for controlling of the shovel 100. The details of the machine guidance function and the machine control function are explained later (see FIG. 5).

Some of the functions of the controller 30 may be achieved by other controllers (control devices). In other words, the function of the controller 30 may be achieved as being distributed across multiple controllers. For example, the machine guidance function and the machine control function may be implemented by a dedicated controller (control device).

The discharge pressure sensor 28 detects the discharge pressure of the main pump 14. A detection signal corresponding to the discharge pressure detected by the discharge pressure sensor 28 is input to the controller 30. For example, as explained later, the discharge pressure sensor 28 includes discharge pressure sensors 28L, 28R.

As described above, the operation pressure sensor 29 detects the secondary-side pilot pressure of the operating apparatus 26, i.e., the pilot pressure corresponding to the operation state of operating apparatus 26 for each operation element (i.e., the hydraulic actuators). The detection signal of the pilot pressure corresponding to the operation state of the operating apparatus 26 detected by the operation pressure sensor 29 with respect to the lower traveling body 1, the upper turning body 3, the boom 4, the arm 5, the bucket 6, and the like is input to the controller 30. For example, as explained later, the operation pressure sensor 29 includes operation pressure sensors 29A to 29C.

The proportional valve 31 is provided in a pilot line connecting the pilot pump 15 and the shuttle valve 32, and is configured to be able to change the size of area of flow (i.e., the size of a cross-sectional area in which hydraulic oil can flow). The proportional valve 31 operates in accordance with a control instruction received from the controller 30. Accordingly, even in a case where an operator is not operating the operating apparatus 26 (specifically, the lever device 26A to 26C), the controller 30 can provide hydraulic oil discharged from the pilot pump 15 via the proportional valve 31 and the shuttle valve 32 to a pilot port in a corresponding control valve in the control valve unit 17. For example, as explained later, the proportional valve 31 includes proportional valves 31AL, 31AR, 31BL, 31BR, 31CL, 31CR.

The relief valve 33 discharges the hydraulic oil in the rod-side hydraulic chamber of the boom cylinder 7 to the tank in response to a control signal (control current) from the controller 30, and reduces an excessive pressure in the rod-side hydraulic chamber of the boom cylinder 7.

The display device 40 is provided at a position that can be easily seen by the operator who is seated in the cab 10, and the display device 40 displays various kinds of information images under the control of the controller 30. The display device 40 may be connected to the controller 30 via an onboard communication network such as CAN (Controller Area Network) and the like, and may be connected to the controller 30 via a private telecommunications circuit for connection between two locations.

The input device 42 is provided in an area that can be reached by the operator who is seated in the cab 10, and the operator receives various kinds of operation inputs, and outputs a signal according to an operation input to the controller 30. The input device 42 may include, for example: a touch panel implemented on a display of a display device for displaying various kinds of information images; knob switches provided at the ends of the levers of the lever devices 26A to 26C; and button switches, levers, toggle switches, rotation dials, and the like provided around the display device 40. Signals corresponding to operation contents of the input device 42 are input to the controller 30.

For example, the sound output device 43 is provided in the cab 10 and connected to the controller 30. The sound output device 43 outputs sound under the control of the controller 30. For example, the sound output device 43 may be a speaker, a buzzer, and the like. The sound output device 43 outputs various kinds of information in response to a sound output instruction from the controller 30.

For example, the storage device 47 is provided in the cab 10, and stores various kinds of information under the control of the controller 30. For example, the storage device 47 includes a non-volatile storage medium such as semiconductor memory. The storage device 47 may store information received from various kinds of devices while the shovel 100 operates, and may store information that is obtained by various kinds of devices before the shovel 100 starts to operate. For example, the storage device 47 may store data of the excavation target surface obtained with a communication device T1 and the like or set with the input device 42 and the like. The excavation target surface may be set (saved) by the operator of the shovel 100, or may be set by construction managers and the like.

The boom angle sensor S1 is attached to the boom 4 to detect the elevation angle of the boom 4 with respect to the upper turning body 3 (hereinafter referred to as "boom angle"). For example, the boom angle sensor S detects the angle formed by a straight line connecting both ends of the boom 4 with respect to the turning plane of the upper turning body 3 in a side view. The boom angle sensor S1 may include, for example, a rotary encoder, an acceleration sensor, a six-axis sensor, an IMU (Inertial Measurement Unit), and the like. The arm angle sensor S2, the bucket angle sensor S3, and the shovel body inclination sensor S4 are similarly configured as described above. The detection signal corresponding to the boom angle detected by the boom angle sensor S1 is input to the controller 30.

The arm angle sensor S2 is attached to the arm 5 to detect a rotation angle of the arm 5 with respect to the boom 4 (hereinafter referred to as "arm angle"). For example, the arm angle sensor S2 detects an angle formed by a straight line connecting both of the rotational axes points at both ends of the arm 5 with respect to a straight line connecting both of the rotational axes points at both ends of the boom 4 in a side view. The detection signal corresponding to the arm angle detected by the arm angle sensor S2 is input to the controller 30.

The bucket angle sensor S3 is attached to the bucket 6 to detect a rotation angle of the bucket 6 with respect to the arm 5 (hereinafter referred to as "bucket angle"). For example, the bucket angle sensor S3 detects an angle formed by a straight line connecting both of the rotational axes points at both ends of the bucket 6 with respect to a straight line connecting both of the rotational axes points at both ends of the arm 5 in a side view. The detection signal corresponding to the bucket angle detected by the bucket angle sensor S3 is input to the controller 30.

The body inclination sensor S4 detects the inclination state of the body (the upper turning body 3 or the lower traveling body 1) with respect to the horizontal plane. For example, the body inclination sensor S4 is attached to the upper turning body 3 to detect inclination angles about two axes, i.e., an inclination angle in the longitudinal direction and an inclination angle in a lateral direction of the shovel 100 (i.e., the upper turning body 3), which are hereinafter referred to as a "longitudinal inclination angle" and a "lateral inclination angle", respectively. Detection signals corresponding to inclination angles (i.e., the longitudinal inclination angle and the lateral inclination angle) detected by the body inclination sensor S4 are input to the controller 30.

The turning state sensor S5 outputs detection information about the turning state of the upper turning body 3. For example, the turning state sensor S5 detects a turning angular speed and a turning angle of the upper turning body 3. For example, the turning state sensor S5 may include a gyro sensor, a resolver, a rotary encoder, and the like.

The image-capturing device S6 captures images around the shovel 100. The image-capturing device S6 includes a camera S6F configured to capture images in front of the shovel 100, a camera S6L configured to capture images at the left-hand side of the shovel 100, a camera S6R configured to capture images at the right-hand side of the shovel 100, and a camera S6B configured to capture images at the rear of the shovel 100.

For example, the camera S6F is attached to the inside of the cab 10, e.g., the ceiling of the cab 10. Alternatively, the camera S6F may be attached to the outside of the cab 10, e.g., the roof of the cab 10 or the side surface of the boom 4. The camera S6L is attached to the left end on the upper surface of the upper turning body 3, the camera S6R is attached to the right end on the upper surface of the upper turning body 3, and the camera S6B is attached to the rear end on the upper surface of the upper turning body 3.

In the image-capturing device S6, for example, each of the cameras S6F, S6B, S6L, S6R is a single-lens wide-angle camera having an extremely wide field of view. Alternatively, the image-capturing device S6 may include a stereo camera, a distance image sensor, and the like. Images captured by the image-capturing device S6 are input to the controller 30 via the display device 40.

The image-capturing device S6 may function as an object detection device. In this case, the image-capturing device S6 may detect an object around the shovel 100. Examples of objects that are detected by the image-capturing device S6 include topographic features (inclination, holes, and the like), people, animals, vehicles, construction machines, structures, walls, helmets, safety vests, work clothes, prescribed marks on helmets, and the like. The image-capturing device S6 may be configured to calculate a distance to a detected object from the image-capturing device S6 or from the shovel 100. When the image-capturing device S6 works as an object detection device, the image-capturing device S6 may include an ultrasonic sensor, a millimeter wave radar, a stereo camera, a LIDAR (Light Detection and Ranging), a distance image sensor, an infrared sensor, and the like. For example, the object detection device is a single-lens camera having image-capturing devices such as a CCD (Charge-Coupled Device) image sensor and a CMOS (Complementary Metal-Oxide-Semiconductor) image sensor, and outputs the captured images to the display device 40. Also, the object detection device may be configured to calculate the distance to a detected object from the object detection device or from the shovel 100. When the image-capturing device S6 uses captured image information but also a millimeter wave radar, an ultrasonic sensor, a laser radar, or the like as the object detection device, many signals (e.g., millimeter waves, ultrasonic waves, laser lights, and the like) may be transmitted to the surroundings, and the reflection signals of the transmitted signals may be received, so that the distance and the direction to the object may be detected from the reflection signals. In this manner, the object detection device may be configured to be able to identify at least one of the type, position, shape, and the like of the object. For example, the object detection device may be configured to be able to distinguish between people and objects other than people.

The image-capturing device S6 may be directly communicably connected to the controller 30.

The boom rod pressure sensor S7R and the boom bottom pressure sensor S7B are attached to the boom cylinder 7 to detect the pressure of the rod-side oil chamber of the boom cylinder 7 (hereinafter referred to as "boom rod pressure") and the pressure of the bottom-side oil chamber of the boom cylinder 7 (hereinafter referred to as "boom bottom pressure"), respectively. The detection signals corresponding to the boom rod pressure and the boom bottom pressure detected by the boom rod pressure sensor S7R and the boom bottom pressure sensor S7B, respectively, are input to the controller 30.

The arm rod pressure sensor S8R and the arm bottom pressure sensor S8B are attached to the arm cylinder 8 to detect the pressure of the rod-side oil chamber of the arm cylinder 8 (hereinafter referred to as "arm rod pressure") and the pressure of the bottom-side oil chamber of the arm cylinder 8 (hereinafter referred to as "arm bottom pressure"), respectively. The detection signals corresponding to the arm rod pressure and the arm bottom pressure detected by the arm rod pressure sensor S8R and the arm bottom pressure sensor S8B, respectively, are input to the controller 30.

The bucket rod pressure sensor S9R and the bucket bottom pressure sensor S9B are attached to the bucket cylinder 9 to detect the pressure of the rod-side oil chamber of the bucket cylinder 9 (hereinafter referred to as "bucket rod pressure") and the pressure of the bottom-side oil chamber of the bucket cylinder 9 (hereinafter referred to as "bucket bottom pressure"). The detection signals corresponding to the bucket rod pressure and the bucket bottom pressure detected by the bucket rod pressure sensor S9R and the bucket bottom pressure sensor S9B, respectively, are input to the controller 30.

The positioning device V1 is configured to measure the position and the orientation of the upper turning body 3. The positioning device V1 may be, for example, a GNSS compass, and may detect the position and orientation of the upper turning body 3 to output detection signals corresponding to the position and orientation of the upper turning body 3 to the controller 30. Of the functions of the positioning device V1, a function for detecting the orientation of the upper turning body 3 may be replaced with an azimuth sensor attached to the upper turning body 3.

The communication device T1 communicates with an external device through a predetermined network including a mobile communication network that includes a base station as a terminal, a satellite communication network, the Internet network, and the like. For example, the communication device T1 may include mobile communication modules according to mobile communication standards such as LTE (Long Term Evolution), 4G (4th Generation), 5G (5th Generation), and the like; satellite communication modules for connecting to satellite communication networks; and the like.

[Hydraulic Circuit of Hydraulic Driving System]

Next, the hydraulic circuit of the hydraulic driving system that drives the hydraulic actuator will be described with reference to FIG. 3.

Figure 3:
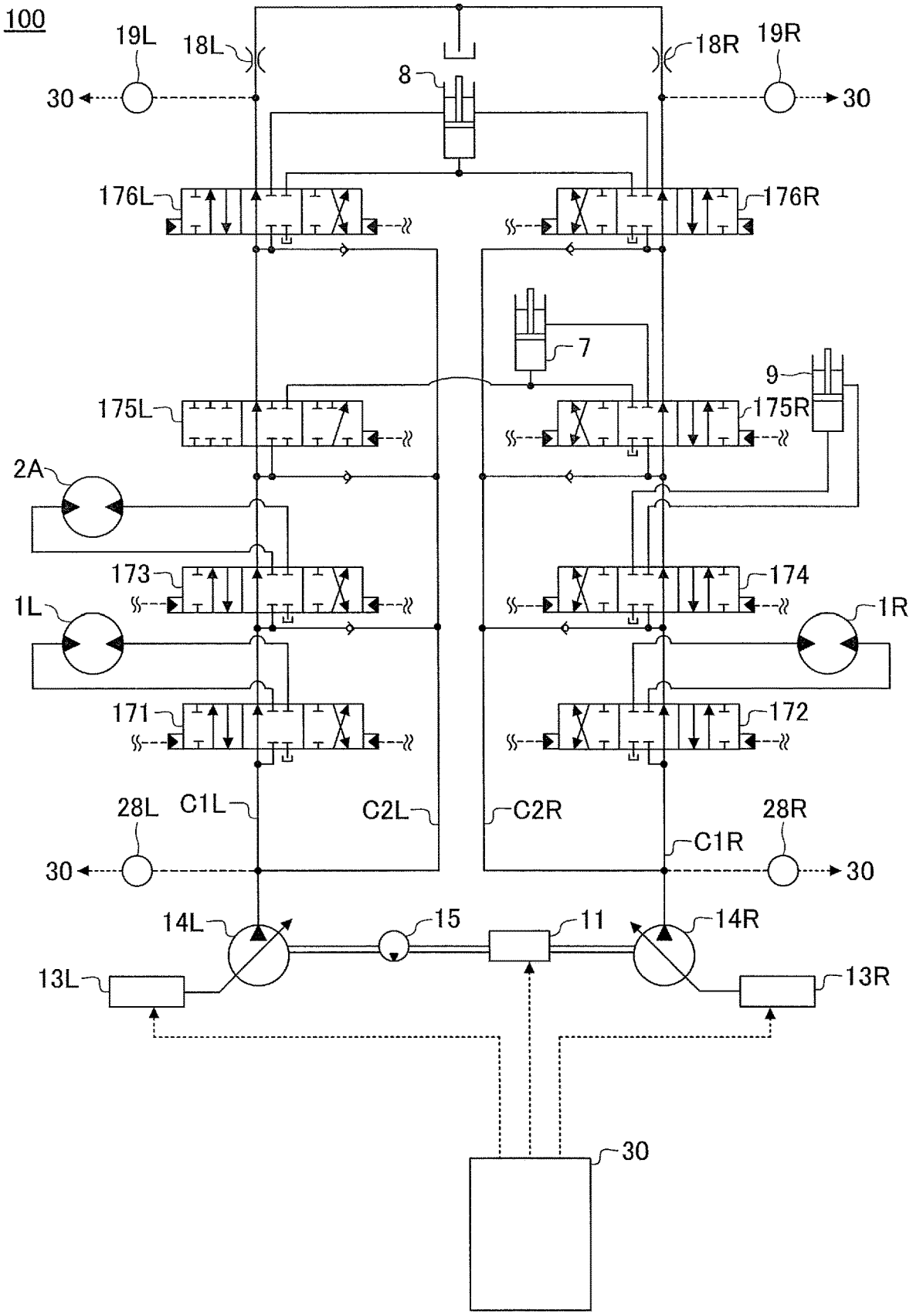
FIG. 3 is a drawing of an example of a hydraulic circuit for driving an attachment.

FIG. 3 is a drawing illustrating an example of the hydraulic circuit of the hydraulic driving system.

In the hydraulic system achieved by the hydraulic circuit, the main pumps 14L, 14R driven by the engine 11 circulate hydraulic oil into the hydraulic oil tank through center bypass pipelines C1L, C1R and parallel pipelines C2L, C2R.

The center bypass pipeline C1L starts from the main pump 14L, passes through, in order, the control valves 171, 173, 175L, 176L provided within the control valve unit 17, and reaches the hydraulic oil tank.

The center bypass pipeline C1R starts from the main pump 14R, passes through, in order, the control valves 172, 174, 175R, 176R provided within the control valve unit 17, and reaches the hydraulic oil tank.

The control valve 171 is a spool valve that supplies the hydraulic oil discharged from the main pump 14L to the traveling hydraulic motor 1L, and that discharges the hydraulic oil discharged from the traveling hydraulic motor 1L to the hydraulic oil tank.

The control valve 172 is a spool valve that supplies the hydraulic oil discharged from the main pump 14R to the traveling hydraulic motor 1R and discharges the hydraulic oil discharged from the traveling hydraulic motor 1R to the hydraulic oil tank.

The control valve 173 is a spool valve that supplies the hydraulic oil discharged from the main pump 14L to the turning hydraulic motor 2A and discharges the hydraulic oil discharged from the turning hydraulic motor 2A to the hydraulic oil tank.

The control valve 174 is a spool valve that supplies the hydraulic oil discharged from the main pump 14R to the bucket cylinder 9 and discharges the hydraulic oil from the bucket cylinder 9 to the hydraulic oil tank.

The control valves 175L, 175R are spool valves that supply the hydraulic oil discharged from the main pumps 14L, 14R to the boom cylinder 7 and discharge the hydraulic oil from the boom cylinder 7 to the hydraulic oil tank.

The control valves 176L, 176R supply the hydraulic oil discharged from the main pumps 14L, 14R to the arm cylinder 8, and discharge the hydraulic oil from the arm cylinder 8 to the hydraulic oil tank.

The control valves 171, 172, 173, 174, 175L, 175R, 176L, and 176R adjust the flow rates of the hydraulic oil supplied to and discharged from the hydraulic actuators and switch the flowing directions according to the pilot pressures acting on the pilot ports.

The parallel pipeline C2L supplies the hydraulic oil of the main pump 14L to the control valves 171, 173, 175L 176L in parallel with the center bypass pipeline C1L. Specifically, the parallel pipeline C2L branches from the center bypass pipeline C1L at the upstream side of the control valve 171, and is configured to supply the hydraulic oil of the main pump 14L to each of the control valves 171, 173, 175L, 176R in parallel. Accordingly, in a case where any one of the control valves 171, 173, 175L limits or cuts off the flow of the hydraulic oil passing through the center bypass pipeline C1L, the parallel pipeline C2L can supply the hydraulic oil to a control valve further downstream.

The parallel pipeline C2R supplies the hydraulic oil of the main pump 14R to the control valves 172, 174, 175R, 176R in parallel with the center bypass pipeline C1R. Specifically, the parallel pipeline C2R branches from the center bypass pipeline C1R at the upstream side of the control valve 172, and is configured to supply the hydraulic oil of the main pump 14R in parallel with each of the control valves 172, 174, 175R, 176R. Accordingly, in a case where any one of the control valves 172, 174, 175R limits or cuts off the flow of the hydraulic oil passing through the center bypass pipeline C1R, the parallel pipeline C2R can supply the hydraulic oil to a control valve further downstream.

The regulators 13L and 13R adjust the amounts of discharge of the main pumps 14L, 14R by adjusting the tilt angles of the swashplates of the main pumps 14L, 14R, respectively, under the control of the controller 30.

The discharge pressure sensor 28L detects the discharge pressure of the main pump 14L. A detection signal corresponding to the detected discharge pressure is input to the controller 30. This is also applicable to the discharge pressure sensor 28R. Accordingly, the controller 30 controls the regulators 13L, 13R according to the discharge pressures of the main pumps 14L, 14R.

The center bypass pipelines C1L, C1R include negative control throttles 18L, 18R between the most downstream control valves 176L, 176R and the hydraulic oil tank. The flow of hydraulic oil discharged from the main pumps 14L, 14R is limited by the negative control throttles 18L, 18R. The negative control throttles 18L, 18R generate a control pressure (hereinafter referred to as a "negative control pressure") so as to control the regulators 13L, 13R.

The negative control pressure sensors 19L, 19R detect negative control pressures. Detection signals corresponding to the detected negative control pressures are input to the controller 30.

The controller 30 may control the regulators 13L, 13R and adjust the amounts of discharge of the main pumps 14L, 14R according to the discharge pressures of the main pumps 14L, 14R detected by the discharge pressure sensors 28L, 28R. For example, the controller 30 may reduce the amount of discharges by controlling the regulator 13L according to the increase of the discharge pressure of the main pump 14L and adjusting the swashplate tilt angle of the main pump 14L. This is also applicable to the regulator 13R. Accordingly, the controller 30 can perform total power control of the main pumps 14L, 14R so that suction power of the main pumps 14L, 14R expressed by a product of the discharge pressure and the amount of discharge does not exceed the output power of the engine 11.

Also, the controller 30 may adjust the amounts of discharge of the main pumps 14L, 14R by controlling the regulators 13L, 13R according to the negative control pressures detected by the negative control pressure sensors 19L, 19R. For example, as the negative control pressure increases, the controller 30 decreases the amounts of discharge of the main pumps 14L, 14R, and as the negative control pressure decreases, the controller 30 increases the amounts of discharge of the main pumps 14L, 14R.

Specifically, in a case where the hydraulic actuator in the shovel 100 is in a standby state (a state as illustrated in FIG. 3) in which no operation is performed, the hydraulic oil discharged from the main pumps 14L, 14R passes through the center bypass pipelines C1L, C1R to reach the negative control throttles 18L, 18R. Then, the flows of the hydraulic oil discharged from the main pumps 14L, 14R increase the negative control pressures generated at the upstream of the negative control throttles 18L, 18R. As a result, the controller 30 decreases the amounts of discharge of main pumps 14L, 14R to the allowable minimum amounts of discharge, and reduces pressure loss (pumping loss) that occurs when the discharged hydraulic oil passes through the center bypass pipelines C1L, C1R.

Conversely, in a case where any one of the hydraulic actuators is operated by the operating apparatus 26, the hydraulic oil discharged from the main pumps 14L, 14R flows via the corresponding control valves to the operation target hydraulic actuators. Accordingly, the amounts of the hydraulic oil discharged from the main pumps 14L, 14R and reaching the negative control throttles 18L, 18R decrease or disappear, so that the negative control pressures occurring at the upstream of the negative control throttles 18L, 18R decrease. As a result, the controller 30 increases the amounts of discharge of main pumps 14L, 14R, and circulates hydraulic oil sufficient for the hydraulic actuators of the operation targets, so that the hydraulic actuators of the operation targets can be driven reliably.

[Example of Hydraulic Circuit (Pilot Circuit) of Operation System]

Figure 4A:
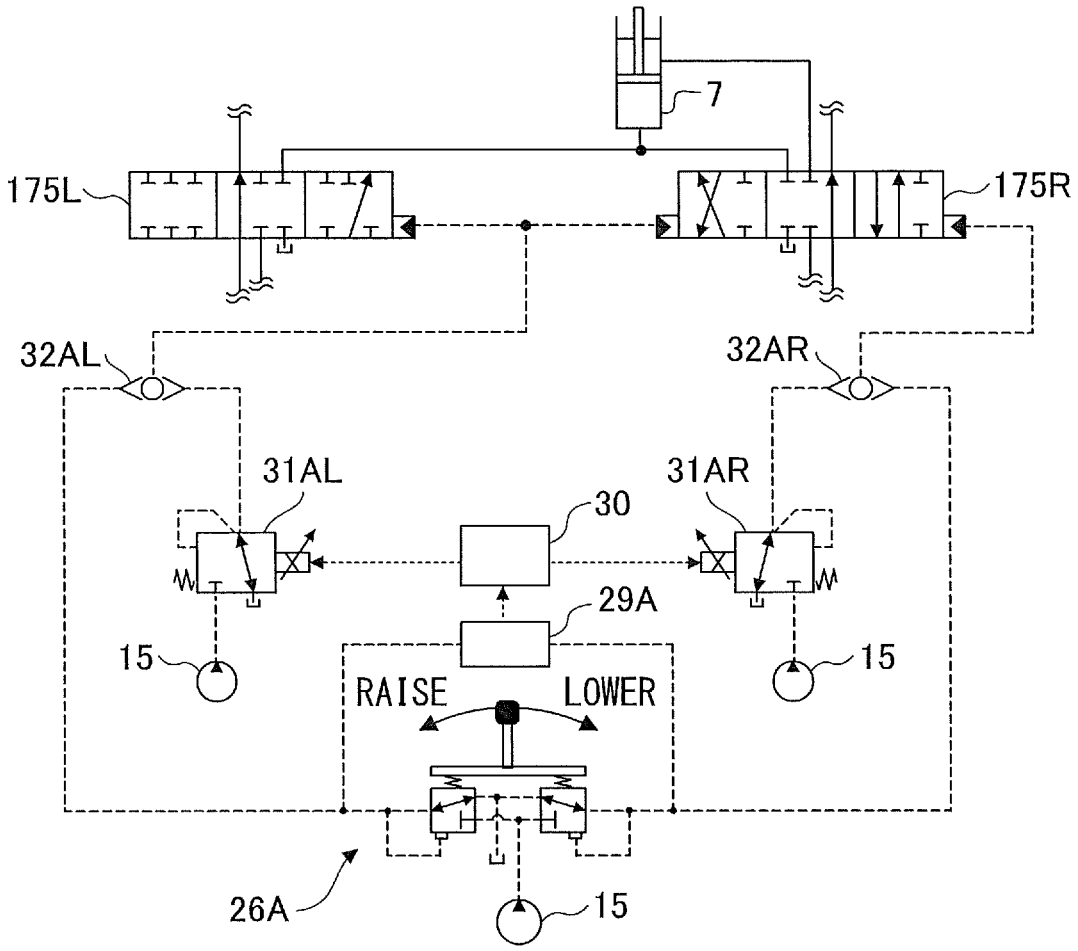
FIG. 4A is a drawing illustrating an example of a pilot circuit applying a pilot pressure to a control valve unit (control valves) for hydraulically controlling the attachment.
Figure 4B:
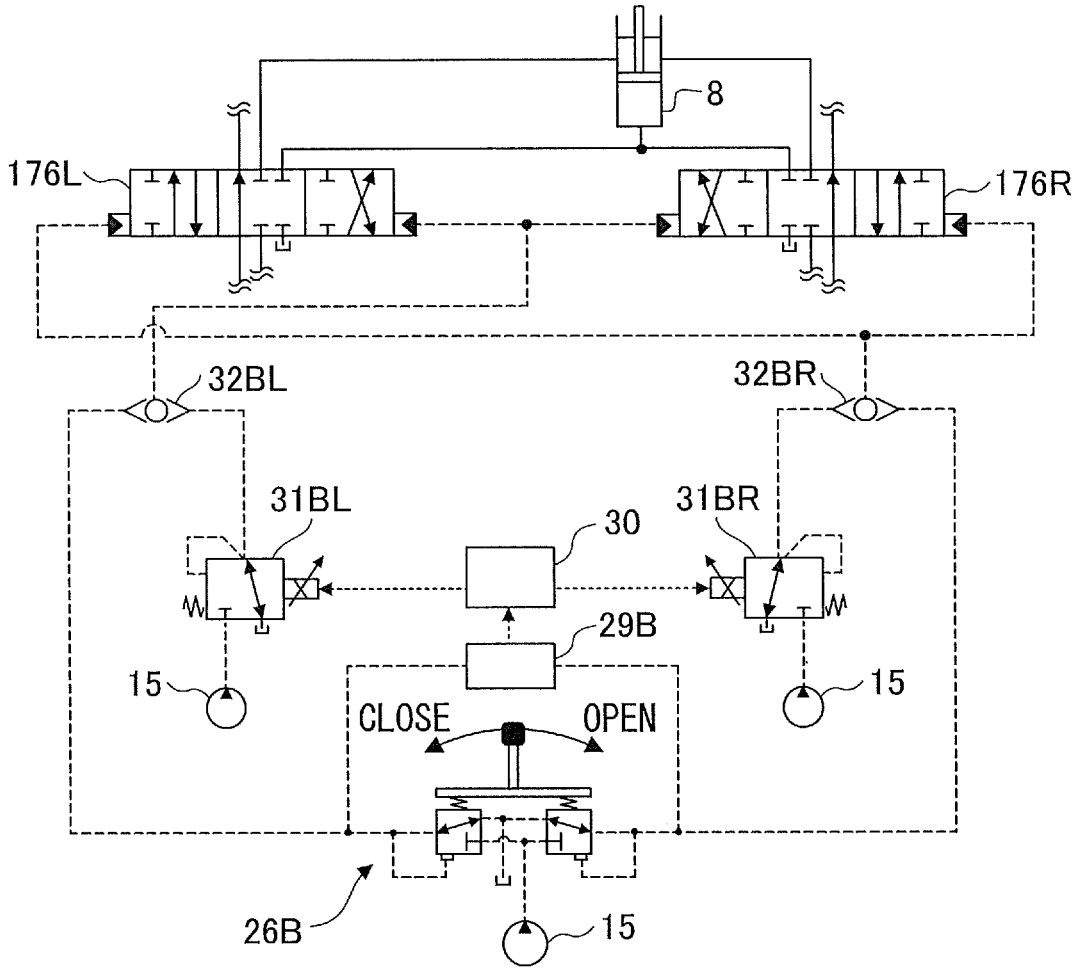
FIG. 4B is a drawing illustrating an example of a pilot circuit for applying a pilot pressure to the control valve unit (control valves) for hydraulically controlling the attachment.
Figure 4C:
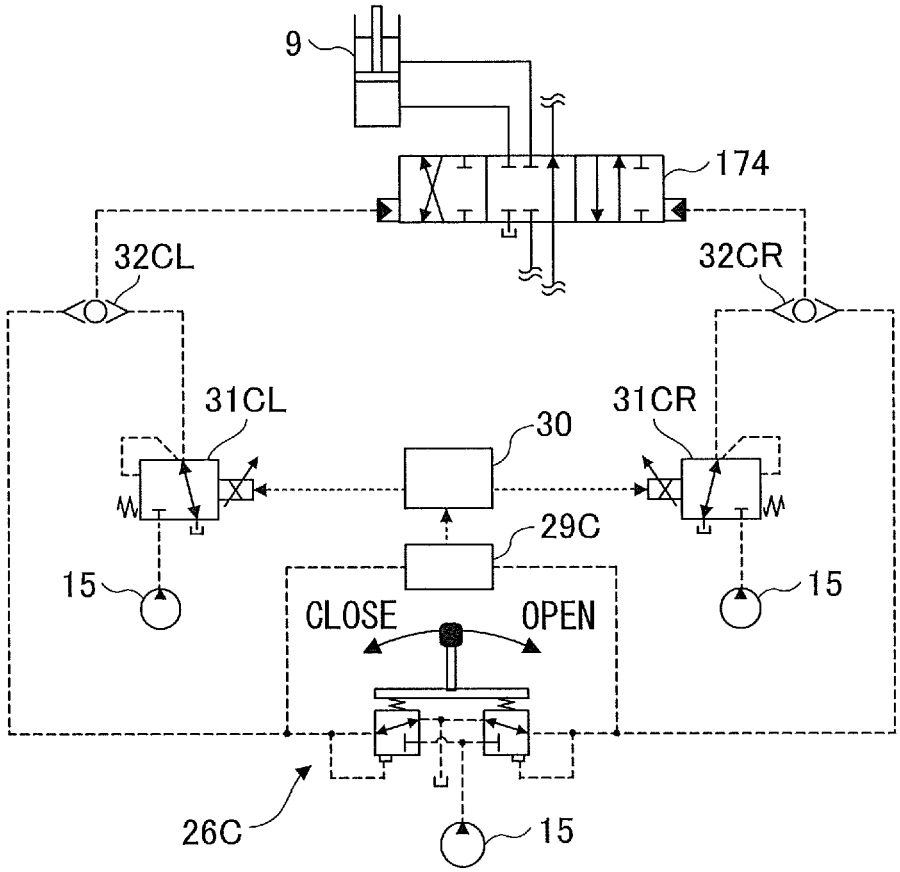
FIG. 4C is a drawing illustrating an example of a pilot circuit for applying a pilot pressure to the control valve unit (control valves) for hydraulically controlling the attachment.

Next, an example of a pilot circuit for applying a pilot pressure to the control valves 174 to 176 related to operation of the hydraulic circuit of the operation system, specifically, the attachment (i.e., the boom 4, the arm 5, and the bucket 6) is explained with reference to FIG. 4 (FIG. 4A to FIG. 4C).

FIGS. 4A to 4C are drawings illustrating examples of configurations of pilot circuits for applying pilot pressures to the control valve unit 17 (the control valves 174 to 176) for hydraulically controlling the hydraulic actuators corresponding to the attachment. Specifically, FIG. 4A is a drawing illustrating an example of a pilot circuit for applying a pilot pressure to the control valve unit (the control valves 175L, 175R) for hydraulically controlling the boom cylinder 7. FIG. 4B is a drawing illustrating an example of a pilot circuit for applying a pilot pressure to the control valves 176L, 176R for hydraulically controlling the arm cylinder 8. FIG. 4C is a drawing illustrating an example of a pilot circuit for applying a pilot pressure to the control valve 174 for hydraulically controlling the bucket cylinder 9.

For example, as illustrated in FIG. 4A, the lever device 26A is used to operate the boom cylinder 7 corresponding to the boom 4. In other words, the lever device 26A operates the movement of the boom 4. The lever device 26A uses the hydraulic oil discharged from the pilot pump 15 to output the pilot pressure to the secondary side according to the operation state.

The two respective inlet ports of the shuttle valve 32AL are connected to the secondary-side pilot line of the lever device 26A corresponding to an operation in a direction to raise the boom 4 (hereinafter "boom raising operation") and the secondary-side pilot line of the proportional valve 31AL. The output port of the shuttle valve 32AL is connected to the pilot port at the right side of the control valve 175L and the pilot port at the left side of the control valve 175R.

The two respective inlet ports of the shuttle valve 32AR are connected to the secondary-side pilot line of the lever device 26A corresponding to an operation in a direction to lower the boom 4 (hereinafter "boom lowering operation") and the secondary-side pilot line of the proportional valve 31AR. The output port of the shuttle valve 32AR is connected to the pilot port at the right side of the control valve 175R.

In other words, the lever device 26A applies, to the pilot ports of the control valves 175L, 175R, the pilot pressures according to the operation state via the shuttle valves 32AL, 32AR. Specifically, in a case where the boom raising operation is performed, the lever device 26A outputs the pilot pressure according to the amount of operation to one of the inlet ports of the shuttle valve 32AL to apply the pilot pressure to the pilot port at the right side of the control valve 175L and the pilot port at the left side of the control valve 175R via the shuttle valve 32AL. In a case where the boom lowering operation is performed, the lever device 26A outputs the pilot pressure according to the amount of operation to one of the inlet ports of the shuttle valve 32AR to apply the pilot pressure to the pilot port at the right side of the control valve 175R via the shuttle valve 32AR.

The proportional valve 31AL operates according to the control current received from the controller 30. Specifically, the proportional valve 31AL uses the hydraulic oil discharged from the pilot pump 15 to output a pilot pressure according to a control current received from the controller 30 to the other of the inlet ports of the shuttle valve 32AL.

Accordingly, the proportional valve 31AL can adjust the pilot pressures applied to the pilot port at the right side of the control valve 175L and the pilot port at the left side of the control valve 175R via the shuttle valve 32AL.

The proportional valve 31AR operates according to a control current received from the controller 30. Specifically, the proportional valve 31AR uses the hydraulic oil discharged from the pilot pump 15 to output a pilot pressure according to a control current received from the controller 30 to the other of the inlet ports of the shuttle valve 32AR. Accordingly, the proportional valve 31AR can adjust the pilot pressure applied to the pilot port at the right side of the control valve 175R via the shuttle valve 32AR.

Therefore, regardless of the operation state of the lever device 26A, the proportional valves 31AL, 31AR can adjust the pilot pressure that is output at the secondary side, so that the control valves 175L, 175R can be stopped at any given valve position.

The operation pressure sensor 29A detects, in a form of pressure, the operator's operation state on the lever device 26A. A detection signal corresponding to the detected pressure is input to the controller 30. Accordingly, the controller 30 can ascertain the operation state on the lever device 26A. For example, the operation state includes an operation direction, an amount of operation (an operation angle), and the like. This is also applicable to the lever devices 26B, 26C.

Regardless of the operator's boom raising operation on the lever device 26A, the controller 30 can supply the hydraulic oil discharged from the pilot pump 15 via the proportional valve 31AL and the shuttle valve 32AL to the pilot port at the right side of the control valve 175L and the pilot port at the left side of the control valve 175R. Regardless of the operator's boom lowering operation on the lever device 26A, the controller 30 can supply the hydraulic oil discharged from the pilot pump 15 via the proportional valve 31AR and the shuttle valve 32AR to the pilot port at the right side of the control valve 175R. In other words, the controller 30 can automatically control raising and lowering movement of the boom 4.

As illustrated in FIG. 4B, the lever device 26B is used to operate the arm cylinder 8 corresponding to the arm 5. In other words, the lever device 26B operates the movement of the arm 5. The lever device 26B uses the hydraulic oil discharged from the pilot pump 15 to output the pilot pressure to the secondary side according to the operation state.

The two respective inlet ports of the shuttle valve 32BL are connected to the secondary-side pilot line of the lever device 26B and the secondary-side pilot line of the proportional valve 31BL corresponding to an operation in a direction to close the arm 5 (hereinafter referred to as "arm closing operation"). The output port of the shuttle valve 32BL is connected to the pilot port at the right side of the control valve 176L and the pilot port at the left side of the control valve 176R.

The two respective inlet ports of the shuttle valve 32BR are connected to the secondary-side pilot line of the lever device 26B and the secondary-side pilot line of the proportional valve 31BR corresponding to an operation in a direction to open the arm 5 (hereinafter referred to as "arm opening operation"). The output port of the shuttle valve 32BR is connected to the pilot port at the left side of the control valve 176L and the pilot port at the right side of the control valve 176R.

In other words, the lever device 26B applies the pilot pressure according to the operation state to the pilot ports of the control valves 176L, 176R via the shuttle valve 32BL, 32BR. Specifically, in a case where the arm closing operation is performed with the lever device 26B, the lever device 26B outputs the pilot pressure according to the amount of operation to one of the inlet ports of the shuttle valve 32BL to apply the pilot pressure to the pilot port at the right side of the control valve 176L and the pilot port at the left side of the control valve 176R via the shuttle valve 32BL. Specifically, in a case where the arm opening operation is performed with the lever device 26B, the lever device 26B outputs the pilot pressure according to the amount of operation to one of the inlet ports of the shuttle valve 32BR to apply the pilot pressure to the pilot port at the left side of the control valve 176L and the pilot port at the right side of the control valve 176R via the shuttle valve 32BR.

The proportional valve 31BL operates according to a control current received from the controller 30. Specifically, the proportional valve 31BL uses the hydraulic oil discharged from the pilot pump 15 to output a pilot pressure according to a control current received from the controller 30 to the other of the pilot ports of the shuttle valve 32BL. Accordingly, the proportional valve 31BL can adjust the pilot pressure applied to the pilot port at the right side of the control valve 176L and the pilot port at the left side of the control valve 176R via the shuttle valve 32BL.

The proportional valve 31BR operates according to a control current received from the controller 30. Specifically, the proportional valve 31BR uses the hydraulic oil discharged from the pilot pump 15 to output a pilot pressure according to a control current received from the controller 30 to the other of the pilot ports of the shuttle valve 32BR. Accordingly, the proportional valve 31BR can adjust the pilot pressure applied to the pilot port at the left side of the control valve 176L and the pilot port at the right side of the control valve 176R via the shuttle valve 32BR.

Therefore, regardless of the operation state of the lever device 26B, the proportional valves 31BL, 31BR can adjust the pilot pressure that is output at the secondary side, so that the control valves 176L, 176R can be stopped at any given valve position.

The operation pressure sensor 29B detects, in a form of pressure, the operator's operation state on the lever device 26B. A detection signal corresponding to the detected pressure is input to the controller 30. Accordingly, the controller 30 can ascertain the operation state of the lever device 26B.

Regardless of the operator's arm closing operation on the lever device 26B, the controller 30 can supply the hydraulic oil discharged from the pilot pump 15 to the pilot port at the right side of the control valve 176L and the pilot port at the left side of the control valve 176R via the proportional valve 31BL and the shuttle valve 32BL. Regardless of the operator's arm opening operation on the lever device 26B, the controller 30 can supply the hydraulic oil discharged from the pilot pump 15 to the pilot port at the left side of the control valve 176L and the pilot port at the right side of the control valve 176R via the proportional valve 31BR and the shuttle valve 32BR. In other words, the controller 30 can automatically control opening and closing operation of the arm 5.

As illustrated in FIG. 4C, the lever device 26C is used to operate the bucket cylinder 9 corresponding to the bucket 6. In other words, the lever device 26C operates the movement of the bucket 6. The lever device 26C uses the hydraulic oil discharged from the pilot pump 15 to output the pilot pressure to the secondary side according to the operation state.

The two respective inlet ports of the shuttle valve 32CL are connected to the secondary-side pilot line of the lever device 26C and the secondary-side pilot line of the proportional valve 31CL corresponding to an operation in a direction to close the bucket 6 (hereinafter referred to as "bucket closing operation"). The output port of the shuttle valve 32CL is connected to the pilot port at the left side of the control valve 174.

The two respective inlet ports of the shuttle valve 32AR are connected to the secondary-side pilot line of the lever device 26C and the secondary-side pilot line of the proportional valve 31CR corresponding to an operation in a direction to open the bucket 6 (hereinafter referred to as "bucket opening operation"). The output port of the shuttle valve 32AR is connected to the pilot port at the right side of the control valve 174.

Specifically, the lever device 26C applies the pilot pressure according to the operation state to the pilot ports of the control valve 174 via the shuttle valve 32CL, 32CR. Specifically, in a case where the bucket closing operation is performed with the lever device 26C, the lever device 26C outputs the pilot pressure according to the amount of operation to one of the inlet ports of the shuttle valve 32CL to apply the pilot pressure to the pilot port at the left side of the control valve 174 via the shuttle valve 32CL. In a case where the bucket opening operation is performed with the lever device 26C, the lever device 26C outputs the pilot pressure according to the amount of operation to one of the inlet ports of the shuttle valve 32CR to apply the pilot pressure to the pilot port at the right side of the control valve 174 via the shuttle valve 32CR.

The proportional valve 31CL operates according to a control current received from the controller 30. Specifically, the proportional valve 31CL uses the hydraulic oil discharged from the pilot pump 15 to output a pilot pressure according to a control current received from the controller 30 to the other of the pilot ports of the shuttle valve 32CL. Accordingly, the proportional valve 31CL can adjust the pilot pressure applied to the pilot port at the left side of the control valve 174 via the shuttle valve 32CL.

The proportional valve 31CR operates according to a control current received from the controller 30. Specifically, the proportional valve 31CR uses the hydraulic oil discharged from the pilot pump 15 to output a pilot pressure according to a control current received from the controller 30 to the other of the pilot ports of the shuttle valve 32CR. Accordingly, the proportional valve 31CR can adjust the pilot pressure applied to the pilot port at the right side of the control valve 174 via the shuttle valve 32CR.

Therefore, regardless of the operation state of the lever device 26C, the proportional valves 31CL, 31CR can adjust the pilot pressure that is output at the secondary side, so that the control valve 174 can be stopped at any given valve position.

The operation pressure sensor 29C detects, as pressure, the operation state of the lever device 26C by the operator. A detection signal corresponding to the detected pressure is input to the controller 30. Accordingly, the controller 30 can ascertain the operation content on the lever device 26C.

Regardless of the operator's bucket closing operation on the lever device 26C, the controller 30 can supply the hydraulic oil discharged from the pilot pump 15 to the pilot port at the left side of the control valve 174 via the proportional valve 31CL and the shuttle valve 32CL. Regardless of the operator's bucket opening operation on the lever device 26C, the controller 30 can supply the hydraulic oil discharged from the pilot pump 15 to the pilot port at the right side of the control valve 174 via the proportional valve 31CR and the shuttle valve 32CR. In other words, the controller 30 can automatically control the opening and closing operation of the bucket 6.

It should be noted that the shovel 100 may have a configuration for automatically turning the upper turning body 3. In this case, the pilot circuit for applying a pilot pressure to the control valve 173 also employs a hydraulic system including a proportional valve 31 and a shuttle valve 32 in a manner similar to FIGS. 4A to 4C. Also, the shovel 100 may have a configuration for automatically moving the lower traveling body 1 forward or backward. In this case, the pilot circuit applying the pilot pressure to the control valves 171, 172 corresponding to the travelling hydraulic motors 1L, 1R, respectively, also employs a hydraulic system including a proportional valve 31 and a shuttle valve 32 in a manner similar to FIGS. 4A to 4C. Although the operating apparatus 26 (the lever devices 26A to 26C) has the hydraulic pilot circuit in the above explanation, it may also be possible to employ an electric operating apparatus 26 (lever devices 26A to 26C) having an electric pilot circuit instead of a hydraulic pilot circuit. In this case, the amount of operation of the electric operating apparatus 26 is input as an electric signal to the controller 30. Also, an electromagnetic valve is arranged between the pilot pump 15 and the pilot port of each control valve. The electromagnetic valve is configured to operate according to an electric signal from the controller 30. In this case, when manual operation is performed with the electric operating apparatus 26, the controller 30 controls the electromagnetic valve to increase or decrease the pilot pressure in accordance with an electric signal corresponding to the amount of operation, so that the controller 30 can operate each control valve (i.e., the control valves 171 to 176). Alternatively, each control valve (i.e., the control valves 171 to 176) may be constituted by an electromagnetic spool valve. In this case, the electromagnetic spool valve operates according to an electric signal from the controller 30 corresponding to the amount of operation of the electric operating apparatus 26.

[Details of Machine Guidance Function and Machine Control Function]

Next, the details of the machine guidance function and the machine control function of the shovel 100 are explained with reference to FIG. 5.

Figure 5:
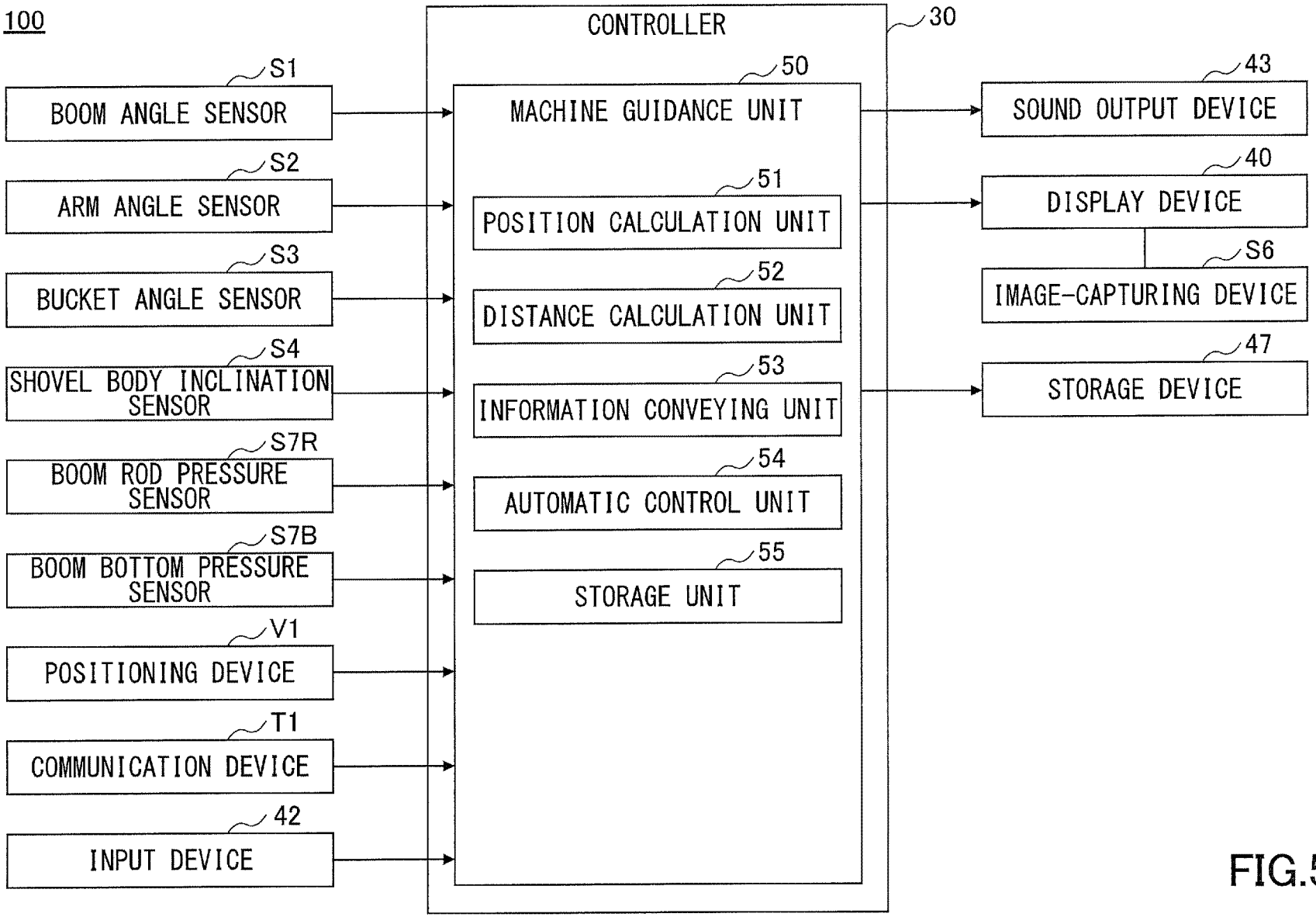
FIG. 5 is a functional block diagram schematically illustrating an example of a functional configuration of machine guidance and machine control functions of the shovel.

FIG. 5 is a functional block diagram schematically illustrating an example of a functional configuration of the machine guidance function and the machine control function of the shovel 100.

For example, the controller 30 includes a machine guidance unit 50 as a functional unit achieved by causing a CPU to execute one or more programs stored in ROM and a nonvolatile auxiliary storage device.

For example, the machine guidance unit 50 controls the shovel 100 with respect to the machine guidance function. For example, the machine guidance unit 50 conveys work information such as a distance between the excavation target surface and an end portion of the attachment (specifically, the bucket 6) to the operator by the display device 40, the sound output device 43, and the like. For example, as described above, data of the excavation target surface is stored in advance in the storage device 47. For example, the data of the excavation target surface is expressed by a reference coordinate system. For example, the reference coordinate system is the World Geodetic System. The World Geodetic System is a three-dimensional orthogonal XYZ coordinate system in which the origin is at the center of gravity of the earth, the X-axis passes through the intersection of the Greenwich meridian and the equator, the Y-axis passes through 90 degrees east longitude, and the Z-axis passes through the north pole. The operator may define any given point on the construction site as a reference point, and may use the input device 42 to set an excavation target surface relative to the reference point. The end portion of the attachment serving as the work part includes teeth end of the bucket 6, the back surface of the bucket 6, and the like. The machine guidance unit 50 notifies work information to the operator with the display device 40, the sound output device 43, and the like, and guides the operator in the operation of the shovel 100 with the operating apparatus 26.

For example, the machine guidance unit 50 controls the shovel 100 with respect to the machine control function. For example, while the operator is manually performing excavation operation, the machine guidance unit 50 may automatically move at least one of the boom 4, the arm 5, and the bucket 6 to cause the end position of the bucket 6 to coincide with the excavation target surface.

The machine guidance unit 50 obtains information from the boom angle sensor S1, the arm angle sensor S2, the bucket angle sensor S3, the shovel body inclination sensor S4, the turning state sensor S5, the image-capturing device S6, the positioning device V1, the communication device T1, the input device 42, and the like. Then, for example, the machine guidance unit 50 calculates the distance between the bucket 6 and the excavation target surface on the basis of the obtained information. Accordingly, for example, the machine guidance unit 50 notifies the operator of the magnitude of the distance between the bucket 6 and the excavation target surface by causing the sound output device 43 to make sound and/or causing the display device 40 to display an image, and the machine guidance unit 50 automatically controls the operation of the attachment so that the end portion of the attachment (the bucket 6) coincides with the excavation target surface. The machine guidance unit 50 includes a position calculation unit 51, a distance calculation unit 52, an information conveying unit 53, and an automatic control unit 54, as a functional configuration of the machine guidance function and the machine control function. Also, the machine guidance unit 50 includes a storage unit 55 as a storage area defined in nonvolatile internal memory such as an auxiliary storage device of the controller 30.

The position calculation unit 51 calculates the position of a positioning target. For example, the position calculation unit 51 calculates the coordinates of the point of the end portion of the attachment (the bucket 6) in the reference coordinate system. Specifically, the position calculation unit 51 calculates the coordinates of the point of the teeth end of the bucket 6 from the elevation angles of the boom 4, the arm 5, and the bucket 6 (i.e., the boom angle, the arm angle, and the bucket angle).

The distance calculation unit 52 calculates a distance between the two positioning targets. For example, the distance calculation unit 52 calculates the vertical distance between the excavation target surface and the end portion of the bucket 6 serving as the work part (for example, the teeth end, the back surface, and the like).

The information conveying unit 53 transmits (notifies) various kinds of information to the operator of the shovel 100 with given notification means such as the display device 40 and the sound output device 43. The information conveying unit 53 notifies the operator of the shovel 100 of the magnitude (degree) of various kinds of distances calculated by the distance calculation unit 52. Specifically, the information conveying unit 53 uses at least one of visual information displayed on the display device 40 and auditory information made by the sound output device 43 to inform the operator of the magnitude of the vertical distance between the end portion of the bucket 6 and the excavation target surface.

Specifically, the information conveying unit 53 uses intermittent sound made with the sound output device 43 to inform the operator of the magnitude of the vertical distance between the work part of the bucket 6 and the excavation target surface. In this case, as the vertical distance decreases, the information conveying unit 53 may decrease the interval of intermittent sound, and as the vertical distance increases, the information conveying unit 53 may increase the interval of intermittent sound. Also, the information conveying unit 53 may use continuous sound and may express difference in the magnitude of the vertical distance by changing the tone of sound, the intensity of sound, and the like. In a case where the end portion of the bucket 6 comes to a position lower than the excavation target surface, i.e., the end portion of the bucket 6 is beyond the excavation target surface, the information conveying unit 53 may give warning with the sound output device 43. For example, this warning is a continuous sound of which volume is significantly larger than the intermittent sound.

The information conveying unit 53 may cause the display device 40 to display the magnitude of the vertical distance between the end portion of the attachment and the excavation target surface. For example, under the control of the controller 30, the display device 40 displays image data received from the image-capturing device S6 and the work information received from the information conveying unit 53. For example, the information conveying unit 53 may use an image of an analog meter, an image of a bar graph indicator, and the like to inform the operator of the magnitude of the vertical distance.

The automatic control unit 54 automatically supports the operator's manual operation of the shovel 100 with the operating apparatus 26 by automatically moving the actuators.

For example, the automatic control unit 54 automatically extends or retracts at least one of the boom cylinder 7, the arm cylinder 8, and the bucket cylinder 9 in order to support the excavation work. Specifically, in a case where the operator is manually performing the arm closing operation, the automatic control unit 54 automatically extends or retracts at least one of the boom cylinder 7, the arm cylinder 8, and the bucket cylinder 9 so that the position of the teeth end of the bucket 6 coincides with the excavation target surface. In this case, for example, the operator can close the arm 5 so as to cause the teeth end of the bucket 6 and the like to coincide with the excavation target surface by just performing an arm closing operation with the lever device 26B. This automatic control may be executed in a case where a predetermined switch included in the input device 42 is pressed down. For example, the switch is a machine control switch (hereinafter referred to as "MC (Machine Control) switch"), which may be provided as a knob switch at an end of a grip portion of the operating apparatus 26 (the lever devices 26A to 26C) gripped by the operator.

The automatic control unit 54 may automatically rotate the turning hydraulic motor 2A to cause the upper turning body 3 to face the excavation target surface. In this case, the operator can cause the upper turning body 3 to face the excavation target surface by just pressing a predetermined switch included in the input device 42. Also, the operator can cause the upper turning body 3 to face the excavation target surface and start the machine control function by just pressing down a predetermined switch included in the input device 42.

The automatic control unit 54 can automatically operate each hydraulic actuator by individually and automatically adjusting the pilot pressure applied to the control valve corresponding to the hydraulic actuator.

The shovel 100 according to the present embodiment performs automatic control of the attachment and the like using the machine control function. In contrast, in a case of conventional manual operation without automatic control, when the operator simply performs the boom lowering operation with the operating apparatus 26, the relative angle of the bucket 6 with respect to the ground changes according to the lowering movement of the boom 4. Therefore, in a case where the shovel 100 performs compaction work, the curved portion of the back surface of the bucket 6 may come into contact with the ground. In this case, the surface pressure that the back surface of the bucket 6 receives from the ground is different from the surface pressure when the flat portion of the back surface of the bucket 6 comes into contact with the ground. As a result, the compaction force that the bucket 6 applies to the ground also changes.

Therefore, in the present embodiment, for example, the automatic control unit 54 automatically extends or retracts at least one of the boom cylinder 7, the arm cylinder 8, and the bucket cylinder 9 to support the compaction work. The compaction work enables work for pressing the back surface of the bucket 6 against the ground to apply a predetermined compaction force to the ground. For example, in a case where the operator manually performs the boom lowering operation, the automatic control unit 54 automatically extends or retracts at least one of the boom cylinder 7, the arm cylinder 8, and the bucket cylinder 9. Therefore, the automatic control unit 54 presses the back surface of the bucket 6 against the earth-placed ground (horizontal surface) with a predetermined pressing force to apply the predetermined pressing force to the ground. In this case, the automatic control unit 54 adjusts the pose of the attachment to cause a relatively flat portion of the back surface of the bucket 6 to come into contact with the ground. In other words, the automatic control unit 54 changes the pose of the attachment to a pose suitable for the compaction work, in a case where the end portion of the attachment (i.e., the bucket 6) is pressed against the ground.

An automatic control of the compaction work (hereinafter referred to as "compaction support control") is executed when, for example, a predetermined switch such as a dedicated switch for compaction support control included in the input device 42 (hereinafter referred to as "compaction support control switch") is pressed down. Alternatively, the compaction support control may be executed when the operating apparatus 26 is operated while a predetermined switch is pressed down. In this case, when the boom lowering operation is performed with the operating apparatus 26 (the lever device 26A) while the compaction support control switch is pressed down, the automatic control unit 54 automatically causes the back surface of the bucket 6 to come into contact with the excavation target surface. In other words, the automatic control unit 54 controls the arm 5 and the bucket 6 so that the flat portion of the back surface of the bucket 6, which is a work part, comes into contact with the excavation target surface in a parallel state according to the boom lowering operation. In this state, when the operator performs the boom lowering operation with the operating apparatus 26 (the lever device 26A), the automatic control unit 54 presses the flat portion of the back surface of the bucket 6 against the ground to start the compaction work while the pose of the flat portion of the back surface of the bucket 6 is automatically maintained. During this compaction work, the automatic control unit 54 (specifically, a pose state determination unit 542 to be explained later) determines the pose of the attachment. This is because, the pressing force applied by the bucket 6 to the ground changes according to the pose of the attachment even when the cylinder pressure of the boom cylinder 7 is the same, as explained later. Therefore, while the bucket 6 is pressed against the ground (during compaction work), the automatic control unit 54 controls the cylinder pressure of the boom cylinder 7 according to the pose of the attachment, so that a predetermined compaction force is generated even when the pose of the attachment changes. Also, the compaction support control may be automatically started in a case where the compaction work of the shovel 100 is performed (started). In this case, the controller 30 predicts a subsequent task on the basis of operation inclination of the operating apparatus 26 by the operator and situations in the surroundings of the shovel 100 that can be determined from images captured by the image-capturing device S6, and in a case where the predicted subsequent task is compaction work, the controller 30 may automatically start the compaction support control.

In this manner, in the present embodiment, when the operator performs the boom lowering operation, the flat portion of the back surface of the bucket 6 is pressed against the ground in a direction perpendicular to the excavation target surface to apply the predetermined compaction force to the ground while the pose of the flat portion of the back surface of the bucket 6 is maintained. Thereafter, with the pressing of the bucket 6, the ground surface sinks.

In this case, when the ground surface becomes lower than a target height (the excavation target surface), the operator judges that a sufficient height is not obtained at a portion where earth is placed and compacted by the shovel 100. Accordingly, the operator performs earth-placing work again with the shovel 100, and thereafter, performs compaction work in which the shovel 100 applies the predetermined compaction force based on the compaction support control again. The target height is a height from a predetermined reference surface. The reference surface is, for example, a ground surface before a bank of earth is placed. Alternatively, the reference surface may be set on the basis of a reference point in a work site.

Conversely, when the height of the compacted ground surface is equal to or more than the target height even after the ground surface sinks due to the pressing of the bucket 6, the operator judges that a sufficient compaction force has been successfully applied, and proceeds to compaction work for a subsequent location.

In this case, the controller 30 can ascertain the locations compacted by the shovel 100 by using pose sensors such as the positioning device V1, the boom angle sensor S1, the arm angle sensor S2, the bucket angle sensor S3, and the like. Therefore, the controller 30 can generate complex information, in which the locations where the compaction work has been completed are mapped on terrain information stored in advance, in the storage device 47 and the like, and can display the complex information on the display device 40. Also, the controller 30 may generate complex information in which the locations where the ground surface is lower than the target height are mapped on the terrain information, and may display the complex information on the display device 40. Accordingly, the operator can ascertain the progress of the compaction work and the earth placing work.

In the compaction work performed by the shovel 100, when the pressing force applied by the bucket 6 is too strong, the shovel body (the lower traveling body 1) of the shovel 100 is greatly lifted, which could lead to damage to the component parts depending on the cases. On the contrary, when the pressing force is too weak, soft ground may be formed. The force (pressing force) exerted on the ground by the back surface of the bucket 6 changes according to the pose of the attachment. Therefore, it is difficult even for an experienced operator to maintain an appropriate pressing force applied to the ground with the back surface of the bucket 6 during the compaction work with the operator's manual operation. The automatic control unit 54 can solve such a problem with the compaction support.

Also, based on the work situations, the automatic control unit 54 may output a notification to prompt the operator to execute compaction work according to the compaction support control with the display device 40, the sound output device 43, and the like. For example, when a thickness of a bank of earth placed by the attachment in an area defined in advance as a target area of compaction becomes equal to or more than a certain thickness, the automatic control unit 54 outputs a notification to prompt the operator to execute compaction work according to the compaction support control with the display device 40, the sound output device 43, and the like. This is because, in the compaction work of the portion where the earth is placed, when the amount of placed earth is too large, the placed earth cannot be sufficiently compacted, which leads to the collapse of the portion where the earth is placed, and therefore, it is necessary to stack, in a stepwise manner, multiple layers of relatively thin banks of earth compacted by compaction. With the above configuration, the user can avoid placing too much earth, which improves the convenience for the user and improves the work efficiency.

In a case where the compaction work has been completed in the target area of compaction which is set in advance by the input device 42 and the like, the automatic control unit 54 may output a notification, with the display device 40, the sound output device 43, and the like, to prompt the operator to proceed to a subsequent task which is set in advance. With this notification, the operator can recognize that the compaction work in the target area is finished, which improves the convenience and improves the work efficiency. The automatic control unit 54 may determine whether the compaction work in the target area of compaction is finished on the basis of images and the like captured by the image-capturing device S6.

The details of the compaction support control by the automatic control unit 54 are explained later (see FIG. 7).

The storage unit 55 stores (saves) various kinds of information about the machine guidance function and the machine control function. For example, the storage unit 55 stores various kinds of setting values about the machine guidance function and the machine control function. For example, the storage unit 55 stores (saves) a target compaction force in the compaction support control (hereinafter referred to as "target compaction force").

The content stored in the storage unit 55 may be stored (saved) in the storage device 47 provided outside of the controller 30.

[Force Applied to Shovel]

Next, a calculation method of work reaction force by the controller 30, which is a basis of the compaction support control, is explained with reference to FIG. 6.

Figure 6:
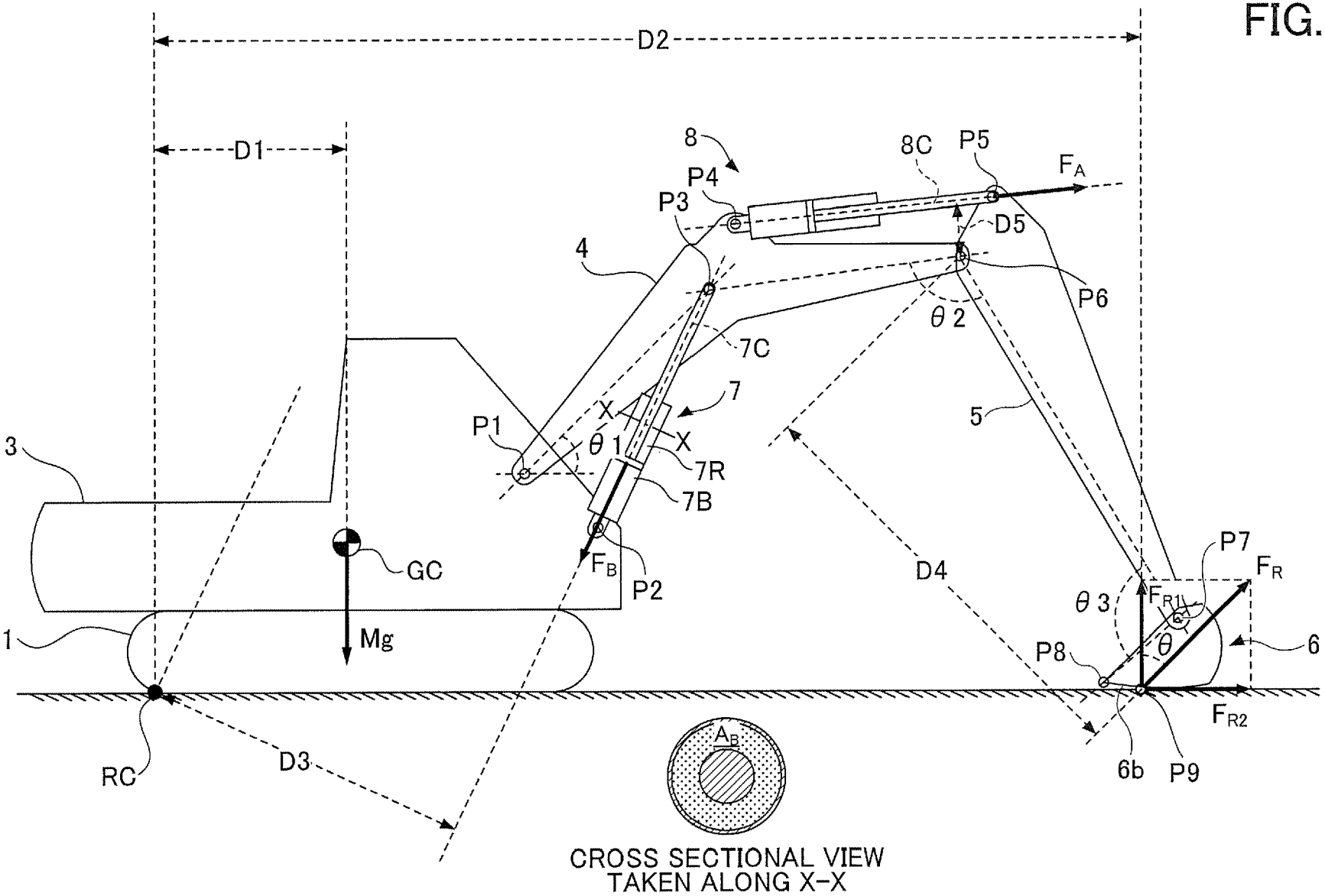
FIG. 6 is a schematic diagram illustrating a relationship of forces applied to the shovel (specifically, the attachment) during compaction work.

FIG. 6 is a schematic view illustrating a relationship of forces exerted on the shovel 100 (the attachment) during the compaction work.

In the compaction work, when the shovel 100 moves the end portion of the attachment, i.e., the back surface of the bucket 6, along the excavation target surface so as to make the shape of terrain in the same shape as the excavation target surface, the shovel 100 drives the boom 4 upward and downward in response to the closing operation of the arm 5. At this occasion, the thrust of the boom that occurs during the lowering movement of the boom 4 is transmitted to the ground surface as a compaction force. Hereinafter, the relationship of forces when the thrust of the boom is transmitted to the ground surface is explained in a concrete manner.

In FIG. 6, a point P1 denotes a connection point between the upper turning body 3 and the boom 4, and a point P2 denotes a connection point between the upper turning body 3 and the cylinder of the boom cylinder 7. A point P3 denotes a connection point between a rod 7C of the boom cylinder 7 and the boom 4. A point P4 denotes a connection point between the boom 4 and the cylinder of the arm cylinder 8. A point P5 denotes a connection point between a rod 8C of the arm cylinder 8 and the arm 5. A point P6 denotes a connection point between the boom 4 and the arm 5. A point P7 denotes a connection point between the arm 5 and the bucket 6. A point P8 denotes an end of the bucket 6. A point P9 denotes a predetermined point on a back surface 6*b* of the bucket 6.

In FIG. 6, for the sake of clarifying the explanation, the bucket cylinder 9 is not shown.

In FIG. 6, a boom angle θ1 denotes an angle formed between a straight line between a point P1 and a point P3 and the horizontal line, an arm angle θ2 denotes an angle formed between a straight line between a point P3 and a point P6 and a straight line between a point P6 and a point P7, and a bucket angle θ3 denotes an angle formed between a straight line between a point P6 and a point P7 and a straight line between a point P7 and a point P8.

Further, in FIG. 6, a distance D1 denotes a horizontal distance between a rotation center RC about which the shovel body lifts up and the center-of-gravity GC of the shovel 100, i.e., a distance between the rotation center RC and a line of action of the gravity M·g, which is a product of the mass M of the shovel 100 and the gravitational acceleration g. A product of the distance D1 and the magnitude of the gravity M·g represents the magnitude of the moment of a first force around the rotation center RC.

It should be noted that a symbol "·" denotes multiplication.

For example, the position of the rotation center RC is determined based on the output of the turning state sensor S5. For example, in a case where the turning angle between the lower traveling body 1 and the upper turning body 3 is 0 degrees, the rear end of a portion of the lower traveling body 1 in contact with the ground becomes the rotation center RC. In a case where the turning angle between the lower traveling body 1 and the upper turning body 3 is 180 degrees, the front end of the portion of the lower traveling body 1 in contact with the ground becomes the rotation center RC. In a case where the turning angle between the lower traveling body 1 and the upper turning body 3 is 90 degrees or 270 degrees, side ends of the portion of the lower traveling body 1 in contact with the ground become the rotation center RC.

In FIG. 6, a distance D2 denotes a horizontal distance between the rotation center RC and the point P9, i.e., a distance between the rotation center RC and a line of action of a component (hereinafter referred to as "vertical component") FR1 of a work reaction force FR perpendicular to the ground (in this Example, the horizontal surface). The component FR2 of the work reaction force FR is a component of the work reaction force FR parallel to the ground. A product of the distance D2 and the magnitude of the vertical component FR1 represents the magnitude of the moment of a second force around the rotation center RC.

In this Example, the work reaction force FR forms a work angle θ with respect to the vertical axis. The vertical component FR1 of the work reaction force FR is represented as FR1=FR·cos θ. The work angle θ is calculated on the basis of the boom angle θ1, the arm angle θ2, and the bucket angle θ3. The ground is pressed in the direction perpendicular to the excavation target surface with a force corresponding to the vertical component FR1 of the work reaction force FR. In other words, the vertical component FR1 of the work reaction force FR corresponds to the pressing force of the ground applied by the back surface of the bucket 6 during compaction work. A component (hereinafter referred to as "parallel component") FR2 of the work reaction force FR parallel to the ground does not generate a large force during compaction work. During the compaction work explained in the present embodiment, the vertical component FR1 of the work reaction force FR is a relatively larger force as compared with the parallel component FR2.

In FIG. 6, a distance D3 denotes a distance between the rotation center RC and a straight line between a point P2 and a point P3, i.e., a distance between the rotation center RC and a line of action of the force FB that causes the rod 7C of the boom cylinder 7 to be retracted into the cylinder with hydraulic oil supplied to the rod-side hydraulic chamber of the boom cylinder 7. A product of the distance D3 and the magnitude of the force FB represents the magnitude of the moment of a third force around the rotation center RC. In this Example, the force FB that causes the rod 7C of the boom cylinder 7 to be retracted into the cylinder is caused by the work reaction force FR applied to the point P9 of the back surface 6*b* of the bucket 6.

In FIG. 6, a distance D4 denotes a distance between the line of action of the work reaction force FR and the point P6. A product of the distance D4 and the magnitude of the work reaction force FR represents the magnitude of the moment of a first force around the point P6.

In FIG. 6, the distance D5 denotes a distance between a straight line, between a point P4 and a point P5, and the point P6, i.e., a distance between a line of action of a thrust FA for closing the arm 5 and the point P6. A product of the distance D5 and the magnitude of the thrust FA represents the magnitude of the moment of a second force around the point P6.

It is assumed that the magnitude of the moment of the vertical component FR1 of the work reaction force FR causing the shovel 100 to be lifted with respect to the rotation center RC is replaceable with the magnitude of the moment of the force FB causing the rod 7C of the boom cylinder 7 to be retracted into the cylinder and causing the shovel 100 to lift up with respect to the rotation center RC. In this case, a relationship between the magnitude of the moment of the second force around the rotation center RC and the magnitude of the moment of the third force around the rotation center RC is expressed by the following Expression (1).

$$FR1 \cdot D2 = FR \cdot \cos\theta' D2 = FB \cdot D3 \quad \text{Expression (1)}$$

Furthermore, as illustrated in a cross sectional view taken along X-X of FIG. 6, where the size of an annular pressure-receiving area of a piston facing the rod-side hydraulic chamber 7R of the boom cylinder 7 is denoted as a size of area AB, and a pressure of hydraulic oil in the rod-side hydraulic chamber 7R is denoted as a boom rod pressure PB, the force FB causing the rod 7C of the boom cylinder 7 to be retracted into the cylinder is denoted as FB=PB·AB. Therefore, the following Expression (2) can be derived from the above Expression (1).

It should be noted a symbol "/" denotes a division. The boom rod pressure PB is measured on the basis of the output of the boom rod pressure sensor S7R.

$$PB = FR1 \cdot D2/(AB \cdot D3) \quad (2)$$

The distance D1 is a constant, and the distances D2 to D5 are values, just like the work angle θ, that are determined according to the pose of the excavation attachment, i.e., the boom angle θ1, the arm angle θ2, and the bucket angle θ3. Specifically, the distance D2 is determined according to the boom angle θ1, the arm angle θ2, and the bucket angle θ3, the distance D3 is determined according to the boom angle θ1, the distance D4 is determined according to the bucket angle θ3, and the distance D5 is determined according to the arm angle θ2.

In this manner, the controller 30 can calculate the work reaction force FR by using the above formula and a calculation map based on the above formula. Also, the controller 30 can calculate, as the magnitude of the pressing force, the magnitude of the vertical component FR1 of the work reaction force FR by calculating the work reaction force FR during the compaction work of the shovel 100.

[First Example of Compaction Support Control]

Next, the First Example of the compaction support control performed with the controller 30 (the automatic control unit 54) is explained with reference to FIG. 7 to FIG. 9.

Figure 7:
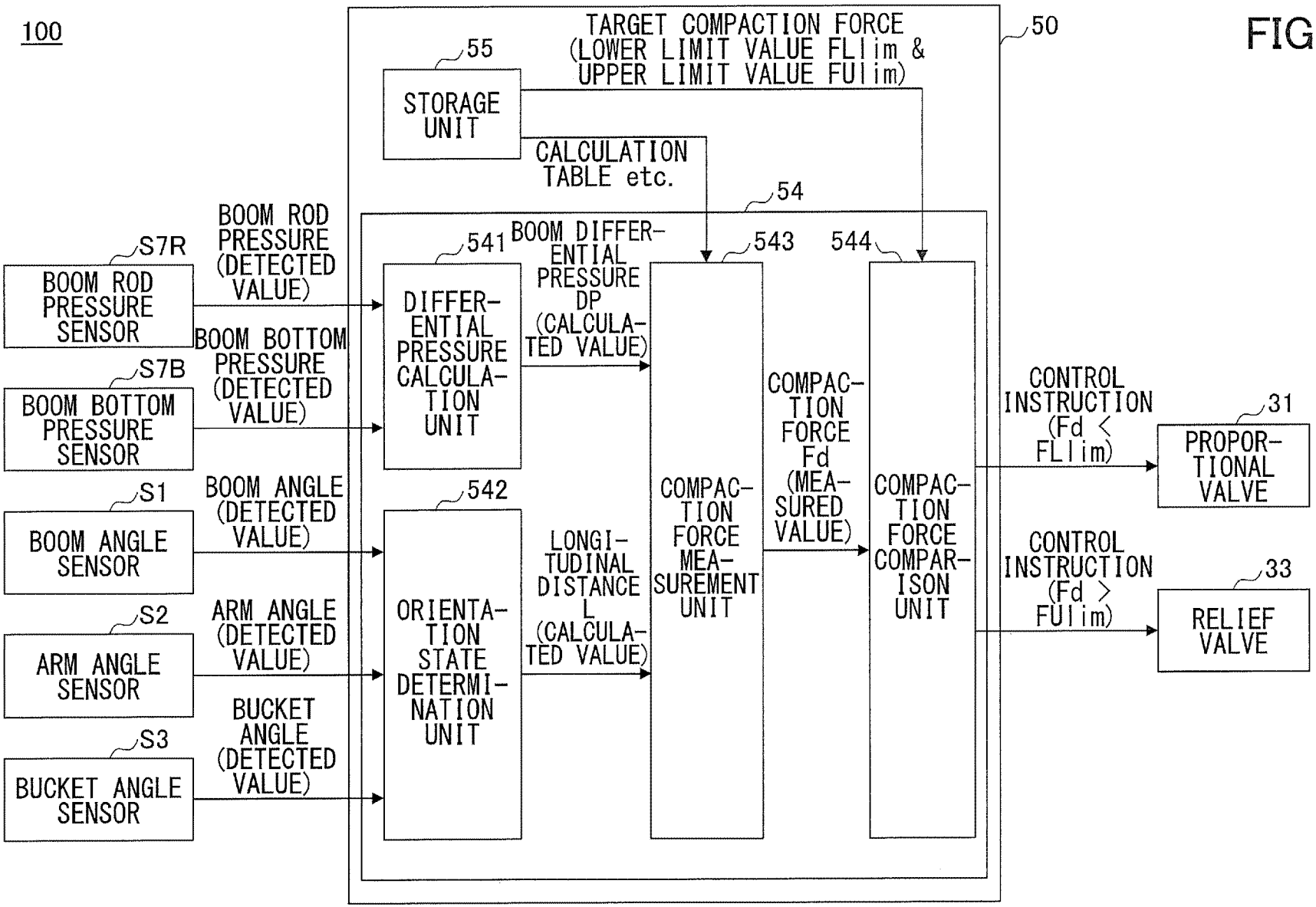
FIG. 7 is a functional block diagram illustrating a First Example of a functional configuration of compaction support control performed by a controller.

FIG. 7 is a functional block diagram illustrating the First Example of the functional configuration of the compaction support control performed with the controller 30 (the machine guidance unit 50). FIG. 8 is a drawing illustrating an example of situation of the compaction work performed by the shovel 100. Specifically, FIG. 8 is a drawing illustrating a situation where the shovel 100 places banks of earth and performs compaction work while the shovel 100 successively changes the excavation target surface from the original ground TP0 to a first layer TP1, a second layer TP2, and then to a third layer TP3 in this order. FIG. 9 is a drawing illustrating an example of a relationship between a differential pressure (hereinafter referred to as "boom differential pressure") DP, between the boom rod pressure and the boom bottom pressure, and a distance in a longitudinal direction (hereinafter referred to as "longitudinal distance") of the bucket 6 from a reference point of the shovel 100 (for example, the position of the connection point of the boom 4 on the upper turning body 3, the front end position of the upper turning body 3, and the like). Specifically, FIG. 9 illustrates contour lines 901, 902 of the bucket 6 with respect to the boom differential pressure DP and the longitudinal distance L.

The compaction force corresponding to the contour line 902 is larger than the compaction force corresponding to the contour line 901. The predetermined distances L1, L2, and Ln in FIG. 9 are the longitudinal distances L corresponding to the compaction positions PS1, PS2, and PSn, respectively, of the bucket 6 in FIG. 8.

As illustrated in FIG. 7, the machine guidance unit 50 (the automatic control unit 54) includes a differential pressure calculation unit 541, a pose state determination unit 542, a compaction force measurement unit 543, and a compaction force comparison unit 544, as a functional configuration for the compaction support control.

The differential pressure calculation unit 541 calculates a differential pressure (hereinafter referred to as "boom differential pressure") DP between the boom rod pressure and the boom bottom pressure on the basis of the detected values of the boom rod pressure and the boom bottom pressure received from the boom rod pressure sensor S7R and the boom bottom pressure sensor S7B, respectively.

The pose state determination unit 542 determines the pose state of the attachment on the basis of the detected values of the boom angle, the arm angle, and the bucket angle received from the boom angle sensor S1, the arm angle sensor S2, and the bucket angle sensor S3 (each of which is an example of a pose detection unit). For example, the pose state determination unit 542 calculates position information about the end portion of the bucket 6 determined by the pose state of the attachment, i.e., a predetermined point on the back surface of the bucket 6 that comes into contact with the ground. Specifically, the pose state determination unit 542 may calculate the longitudinal distance L of the bucket 6.

The compaction force measurement unit 543 calculates (measures) the compaction force Fd currently applied to the ground by the bucket 6 on the basis of the boom differential pressure DP and the longitudinal distance L calculated by the differential pressure calculation unit 541 and the pose state determination unit 542, respectively.

As described above, the work reaction force is caused by a force causing the rod 7C of the boom cylinder 7 to be retracted into the cylinder by the hydraulic oil supplied to the rod-side hydraulic chamber of the boom cylinder 7. Therefore, as the boom differential pressure DP increases, the vertical component of the work reaction force, i.e., the compaction force Fd applied from the bucket 6 to the ground, increases.

Even when the boom differential pressure is the same, the compaction force Fd applied from the bucket 6 to the ground changes according to the pose of the attachment.

Figure 9:
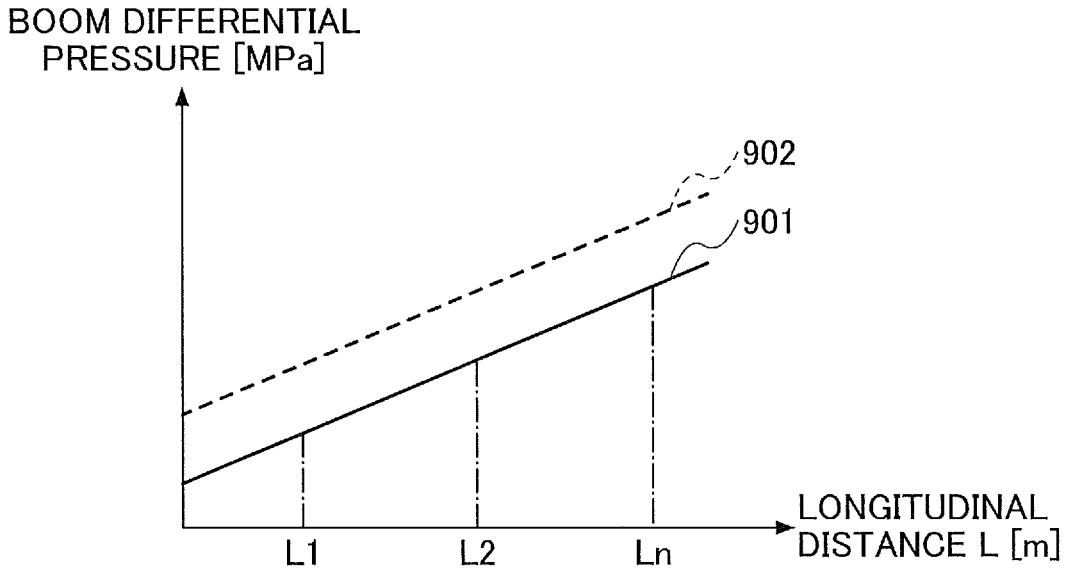
FIG. 9 is a drawing illustrating an example of a relationship between a boom differential pressure and a longitudinal distance of a bucket.

For example, as can be understood from the contour lines 901, 902 of FIG. 9, the compaction force increases according to the increase in the boom differential pressure DP, even when the same longitudinal distance L is the same. The compaction force decreases according to the increase in the longitudinal distance L, even when the boom differential pressure is the same.

It should be noted that the contour line of the compaction force with respect to the boom differential pressure DP and the longitudinal distance L may be non-linear. Instead of the boom differential pressure, the compaction force measurement unit 543 may use calculated (measured) values of the thrust of the arm and the excavation reaction force as the force applied to the shovel 100 with respect to the compaction force. Instead of the longitudinal distance L of the bucket 6, the compaction force measurement unit 543 may use other pose information about the attachment.

The compaction force measurement unit 543 calculates the compaction force Fd on the basis of information indicating a relationship between the boom differential pressure DP, the longitudinal distance L, and the compaction force Fd as illustrated in FIG. 9 (for example, a calculation expression, a calculation map, a calculation table, and the like) stored in the storage unit 55.

The compaction force comparison unit 544 compares the compaction force Fd measured by the compaction force measurement unit 543 and the target compaction force.

The target compaction force includes a lower limit value FLlim and an upper limit value FUlim.

The lower limit value FLlim is set as a minimum required compaction force to ensure the quality of the compaction work.

The upper limit value FUlim is set as an upper limit of the compaction force, so that when the compaction force becomes equal to or more than the upper limit value FUlim, the amount of jack up of the shovel 100 is reduced to a predetermined reference level or less.

In the target compaction force, the lower limit value FLlim corresponding to the quality of the compaction work may be varied according to the soil quality. In other words, in a case where the bucket 6 applies predetermined compaction force to the ground according to the compaction support control, the controller 30 may change the predetermined compaction force according to the soil quality. In this case, the controller 30 may determine the soil quality according to the operator's setting operation on the input device 42 (for example, an operation for making a selection from among a plurality of types of soil qualities displayed on the operation screen of the display device 40). The controller 30 may automatically determine the soil quality on the basis of images captured by the image-capturing device S6. In this Example, occurrence of jack up is determined on the basis of the compaction force, but may be determined by any given method. For example, the controller 30 may determine occurrence of jack up on the basis of the output from the shovel body inclination sensor S4. In this case, the controller 30 may detect the front part of the upper turning body 3 being lifted up on the basis of the output from the shovel body inclination sensor S4, and may determine that jack up occurs in a case where the front part of the upper turning body 3 is lifted up to a predetermined height or to a predetermined angle.

The compaction force comparison unit 544 compares the compaction force Fd measured by the compaction force measurement unit 543 with the lower limit value FLlim and the upper limit value FUlim, and determines whether the measured compaction force Fd is in a range including the lower limit value FLlim and the upper limit value FUlim.

In a case where the measured compaction force Fd is in a range including the lower limit value FLlim and the upper limit value FUlim (FLlim Fd FUlim), the compaction force comparison unit 544 determines that a compaction force required for the compaction work is secured and that the amount of jack up can be reduced to the predetermined reference level or less.

Conversely, in a case where the measured compaction force Fd is less than the lower limit value FLlim (Fd<FLlim), the compaction force comparison unit 544 determines that the compaction force required for the compaction work is not secured. As necessary, the compaction force comparison unit 544 outputs a control instruction to the proportional valve 31 to adjust the operation of the attachment (i.e., the boom 4, the arm 5, and the bucket 6) to increase the compaction force Fd. Accordingly, the compaction force applied to the ground by the bucket 6 is adjusted, and a compaction force required for the compaction work is secured.

In a case where the measured compaction force Fd is more than the upper limit value LUlim (Fd>LUlim), the compaction force comparison unit 544 determines that the amount of jack up of the shovel 100 may exceed the predetermined reference level. As necessary, the compaction force comparison unit 544 outputs a control instruction to the relief valve 33 to discharge the hydraulic oil in the rod-side hydraulic chamber of the boom cylinder 7, in which excessive pressure is generated, to the tank. Accordingly, the compaction force applied to the ground by the bucket 6 is adjusted, and the amount of jack up of the shovel 100 is reduced to the predetermined reference level or less.

During execution of the compaction support control, the compaction force comparison unit 544 repeats the above operation on the basis of the compaction force Fd successively measured by the compaction force measurement unit 543. Accordingly, the compaction force applied to the ground by the bucket 6 is equal to or more than a certain level required for the compaction work, and the amount of jack up of the shovel 100 is reduced to the predetermined reference level or less.

Figure 8:
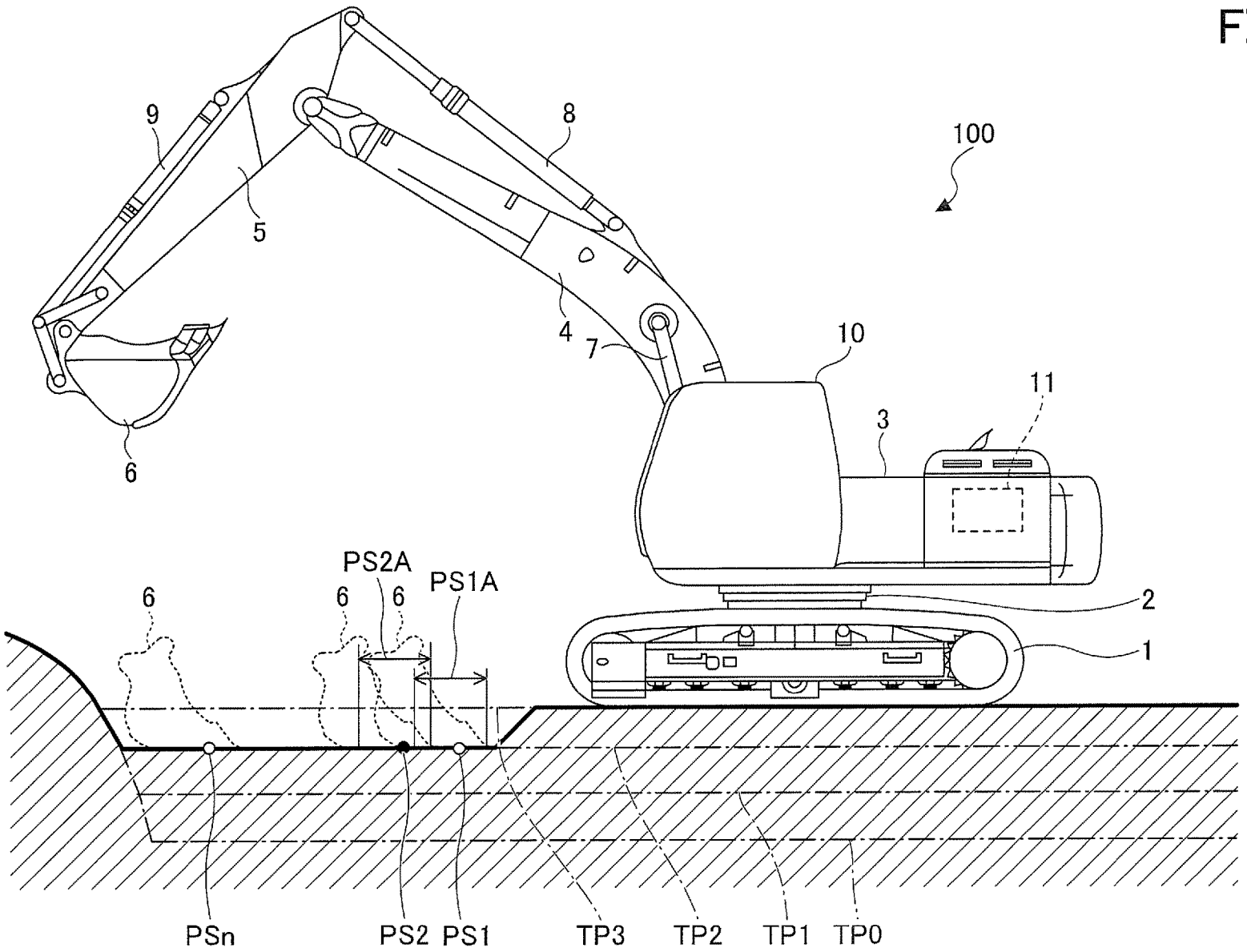
FIG. 8 illustrates an example of situation of compaction work with a shovel.

For example, as illustrated in FIG. 8, in this Example, the shovel 100 starts the compaction work from the compaction position PS1 relatively close to the shovel body. Then, when the shovel 100 performs the compaction work at the compaction position PS1 with the bucket 6 by moving the boom 4, and when the compaction work is completed, the shovel 100 starts the compaction work at the compaction position PS2 adjacent in a direction away from the shovel body of the shovel 100. In this manner, the shovel 100 may successively perform the compaction work at the compaction positions up to PSn (n is an integer equal to or more than 3).

In this case, the compaction work can be performed in such a manner that ranges that can be compacted effectively by the bucket 6 (hereinafter referred to as "effective compaction ranges") partially overlap between any given compaction position PSk (k is an integer equal to or more than 1 and equal to or less than n−1) and any given compaction position PS(k+1). For example, there is a range overlapping, in the horizontal direction of the drawing, between an effective compaction range PS1A of the bucket 6 for the compaction work at the compaction position PS1 and an effective compaction range PS2A of the bucket 6 for the compaction work at the compaction position PS2. Therefore, with the compaction work at the compaction position PSk and the compaction work at the adjacent compaction position PS(k+1), an area where compaction work is performed insufficiently and an area where compaction work is not performed at all can be eliminated.

It should be noted that in FIG. 8, the shovel 100 may perform the compaction operation in such a manner as to move the bucket 6 along the ground from the compaction position PS1 to the compaction position PSn with the bucket 6 being pressed with a certain level of pressing force. In this case, the shovel 100 can start compaction from the compaction position PS1 close to the cab 10, and accordingly, the operator aboard the cab 10 can check the detailed state of the ground that is to be compacted (for example, the state of the soil quality and the like). Also, the compaction work may be performed from a location away from the cab 10, i.e., the compaction position PSn, toward the cab 10.

For example, the shovel 100 according to the present embodiment adjusts the operation of the attachment via the proportional valve 31 in view of the pose state of the attachment (for example, the longitudinal distance L of the bucket 6) in the compaction work as illustrated in FIG. 8. Accordingly, the shovel 100 can secure a certain level of compaction force or more in the compaction work. Therefore, the shovel 100 can finish the ground (for example, the excavation target surface corresponding to the second layer TP2 of FIG. 8) with a higher degree of accuracy in the compaction work. Also, the shovel 100 according to the present embodiment adjusts the operation of the attachment with the relief valve 33 so that the compaction force does not become excessively strong. Therefore, the shovel 100 can reduce the amount of jack up, which could occur during compaction work, to a predetermined reference level or less.

[Another Example of Hydraulic Circuit (Pilot Circuit) of Operation System]

Next, another example of a hydraulic circuit (pilot circuit) of an operation system is explained with reference to FIG. 10.

Figure 10:
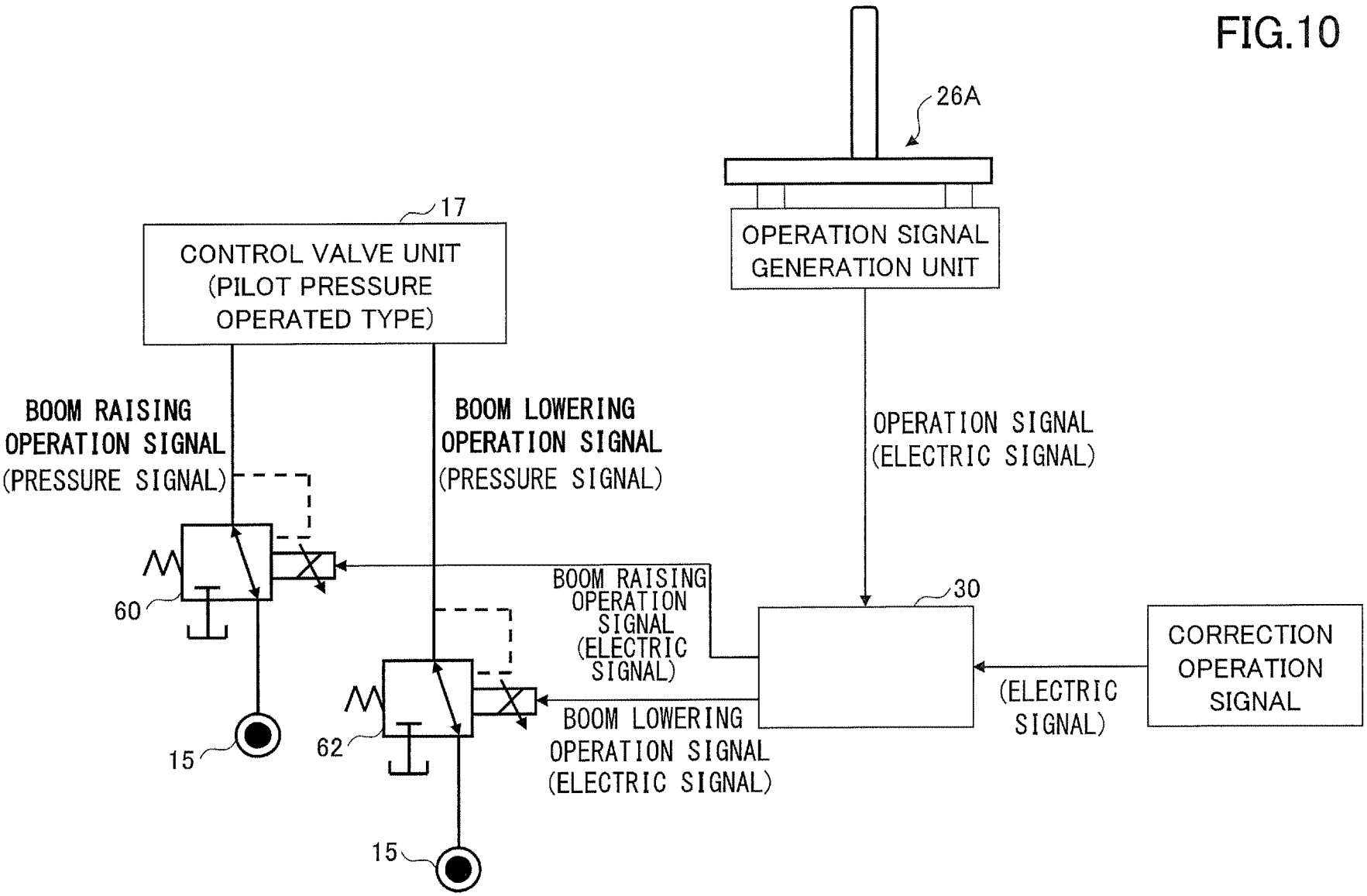
FIG. 10 is a drawing illustrating another example of a pilot circuit for applying a pilot pressure to the control valve unit (i.e., control valves) for hydraulically controlling the attachment.

FIG. 10 is a drawing illustrating another example of a configuration of a pilot circuit for applying a pilot pressure to the control valve unit 17 (the control valves 174 to 176) for hydraulically controlling the hydraulic actuators corresponding to the attachment. Specifically, FIG. 10 is a drawing illustrating another example of a pilot circuit for applying a pressure to the control valve unit 17 (the control valves 175L, 175R) hydraulically controlling the boom cylinder 7.

The pilot circuits for hydraulically controlling the arm cylinder 8 and the bucket cylinder 9 are expressed in a manner similar to the pilot circuit of FIG. 10 for hydraulically controlling the boom cylinder 7. The pilot circuit for hydraulically controlling the travelling hydraulic motors 1L, 1R driving the lower traveling body 1 (i.e., right and left crawlers) can also be implemented in a manner similar to FIG. 10. The pilot circuit for hydraulically controlling the turning hydraulic motor 2A driving the upper turning body 3 can also be implemented in a manner similar to FIG. 10. Therefore, these pilot circuits are not illustrated in the drawings.

The pilot circuit according to this Example includes an electromagnetic valve 60 for boom raising operation and an electromagnetic valve 62 for boom lowering operation.

The electromagnetic valve 60 is configured to be able to adjust the pressure of the hydraulic oil in a hydraulic path (i.e., a pilot line) connecting the pilot pump 15 and the pilot port at the boom raising side of the pilot pressure-operated control valve unit 17 (specifically, the control valve 175 (see FIG. 2, FIG. 3)).

The electromagnetic valve 62 is configured to be able to adjust the pressure of the hydraulic oil in a hydraulic path (i.e., a pilot line) connecting the pilot pump 15 and the pilot port at the boom lowering side of the control valve unit 17 (the control valve 175).

In a case where the boom 4 (the boom cylinder 7) is manually operated, the controller 30 generates a boom raising operation signal (electric signal) or a boom lowering operation signal (electric signal) according to an operation signal (electric signal) output from the lever device 26A (operation signal generation unit). The operation signal (electric signal) that is output from the lever device 26A represents an operation content (for example, the amount of operation and operation direction) of the lever device 26A. The boom raising operation signal (electric signal) and the boom lowering operation signal (electric signal) that are output from the operation signal generation unit of the lever device 26A change in accordance with an operation content (for example, the amount of operation and operation direction) of the lever device 26A.

Specifically, in a case where the lever device 26A is operated in a boom raising direction, the controller 30 outputs a boom raising operation signal (electric signal) according to the amount of operation to the electromagnetic valve 60. The electromagnetic valve 60 operates according to the boom raising operation signal (electric signal) to control the pilot pressure applied to the pilot port at the boom raising side of the control valve 175, i.e., a boom raising operation signal (pressure signal). Likewise, in a case where the lever device 26A is operated in a boom lowering direction, the controller 30 outputs a boom lowering operation signal (electric signal) according to the amount of operation to the electromagnetic valve 62. The electromagnetic valve 62 operates according to the boom lowering operation signal (electric signal) to control the pilot pressure applied to the pilot port at the boom lowering side of the control valve 175, i.e., a boom lowering operation signal (pressure signal). Therefore, the control valve unit 17 can achieve an operation of the boom cylinder 7 (the boom 4) according to an operation content of the lever device 26A.

In a case where the boom 4 (the boom cylinder 7) operates autonomously, for example, the controller 30 generates a boom raising operation signal (electric signal) or a boom lowering operation signal (electric signal) in accordance with a correction operation signal (electric signal), regardless of the operation signal (electric signal) that is output from the operation signal generation unit of the lever device 26A. The correction operation signal may be an electric signal generated by the controller 30 or may be an electric signal generated by a control device other than the controller 30. Accordingly, the control valve unit 17 can achieve an autonomous movement of the boom 4 (the boom cylinder 7) according to the correction operation signal (electric signal).

Also, the movements of the arm 5 (the arm cylinder 8), the bucket 6 (the bucket cylinder 9), the upper turning body 3 (the turning hydraulic motor 2A), and the lower traveling body 1 (the travelling hydraulic motors 1L, 1R) based on similar pilot circuits are similar to the movement of the boom 4 (the boom cylinder 7).

In this manner, in a case where the electric operating apparatus 26 is employed, the controller 30 can execute the autonomous control function of the shovel 100 more easily than in a case where a hydraulic pilot-type operating apparatus 26 is employed.

[Work Support System Including Shovel]

Next, an overview of a work support system including the shovel 100 according to the present embodiment is explained with reference to FIG. 11.

Figure 11:
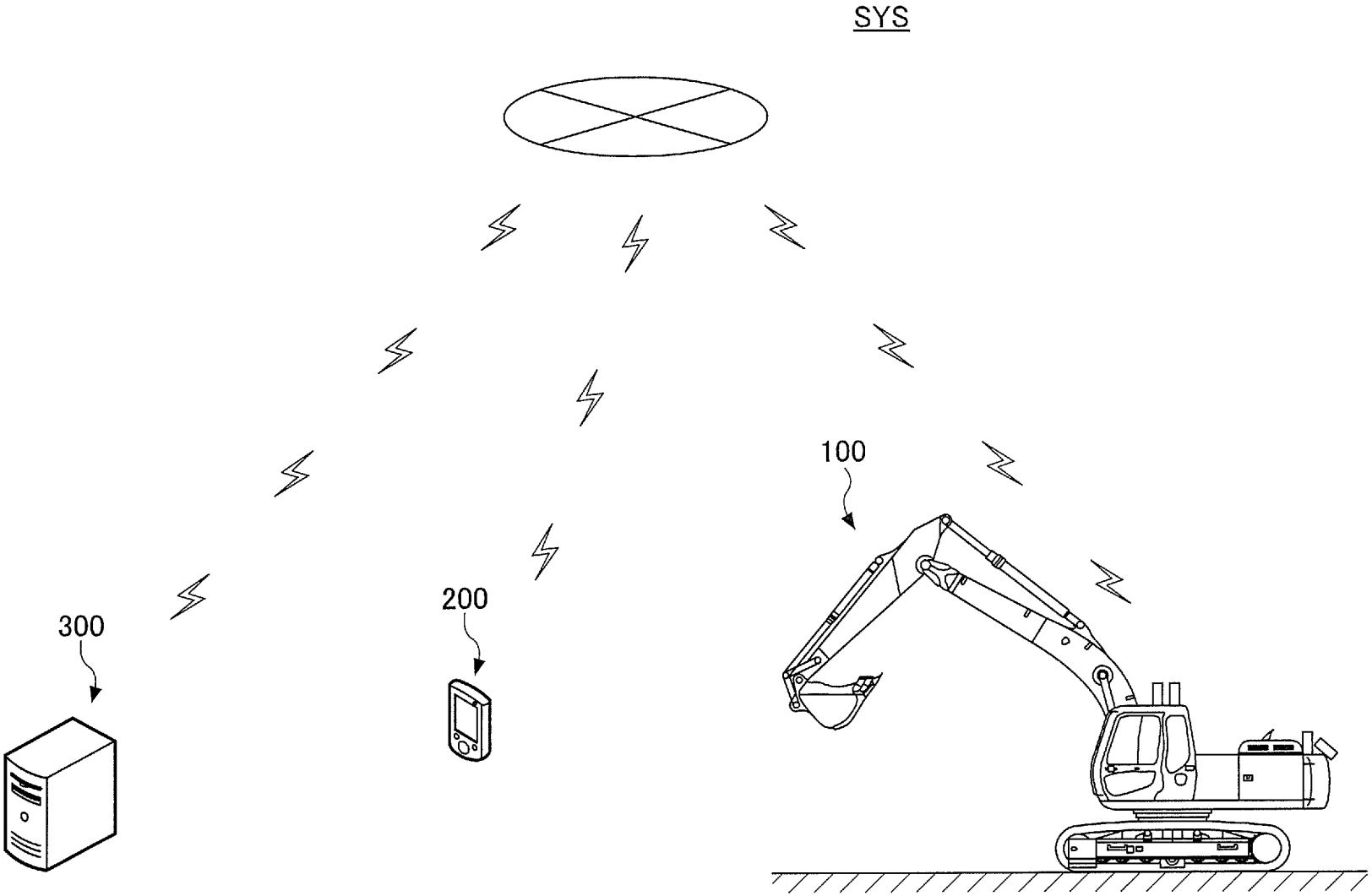
FIG. 11 is a schematic view illustrating an example of a work support system including the shovel.

FIG. 11 is a drawing illustrating an example of a work support system SYS including the shovel 100.

As illustrated in FIG. 11, the work support system SYS includes the shovel 100, a support device 200, and a management device 300.

In this Example, the work support system SYS is configured to be able to perform work support of the shovel 100 with the support device 200 or the management device 300 on the basis of communication between the support device 200 or the management device 300 and the shovel 100.

It should be noted that the work support system SYS may include one or more shovels 100. Also, the work support system SYS includes one or more support devices 200 and one or more management devices 300.

For example, the support device 200 is used by a user related to the shovel 100 (for example, workers and site foremen in a work site of the shovel 100, operators of the shovel 100, and the like) to support the work of the shovel 100. The support device 200 is, for example, a user terminal used by the user related to the shovel 100. Specifically, the support device 200 may be, for example, mobile terminals such as smartphones, tablet terminals, laptop computer terminals, and the like. The support device 200 may be, for example, stationary terminals such as desktop computer terminals installed in a temporary office in a work site.

For example, the support device 200 is communicably connected to the shovel 100 and the management device 300 through a predetermined network including a mobile communication network that includes a base station as a terminal, a satellite communication network, and the like. In this case, the support device 200 may be communicably connected via the management device 300 to the shovel 100. For example, the support device 200 may be configured to be able to directly communicate with the shovel 100 by predetermined short distance communication (for example, Bluetooth communication (registered trademark), WiFi communication, and the like).

For example, the support device 200 may be configured to be able to transmit a control instruction for work support to the shovel 100 in response to an operation of a shovel-related user. Specifically, the support device 200 may be configured to allow the shovel-related user to remotely operate the shovel 100 with the support device 200.

For example, the management device 300 manages an operation, work, activity, and the like of the shovel 100 from a location relatively far from the shovel 100. For example, the management device 300 is a server device installed in a management center and the like outside of the work site. Also the management device 300 may be, for example, computer terminals for management installed in a temporary office in the work site. The management device 300 may be, for example, mobile computer terminals (for example, mobile terminals such as laptop computer terminals, tablet terminals, smartphones, and the like).

For example, like the support device 200, the management device 300 is communicably connected to the shovel 100 through a predetermined network including a mobile communication network that includes a base station as a terminal, a satellite communication network, and the like.

For example, the management device 300 may be configured to be able to transmit a control instruction for work support to the shovel 100 in accordance with an operation of a manager and the like. Specifically, the manager and the like may be allowed to remotely operate the shovel 100 with the management device 300 (see FIG. 16). The manager and the like may cause the management device 300 to execute autonomous remote operation by installing a control program for remote operation to the management device 300 in advance.

In this manner, at least one of the support device 200 and the management device 300 may transmit control instruction for remote operation to the shovel 100 in accordance with an operation of shovel-related users, managers, and the like or in accordance with an operation of the control program installed in the support device 200 or the management device 300. In this case, image information of the surroundings of the shovel 100 transmitted from the shovel 100 may be displayed on a display device (display) of the support device 200 or the management device 300. Therefore, the shovel-related users, managers, and the like who are outside of the cab 10 of the shovel 100 can perform remote operation while finding the situation of the surroundings of the shovel 100 as seen from the shovel body of the shovel 100.

In the work support system SYS of the shovel 100 as described above, for example, the controller 30 of the shovel 100 may transmit work information about the compaction (for example, information about the compaction force, the compaction position, and the like) to the support device 200, the management device 300, and the like via the communication device T.

For example, the work information about the compaction includes at least one of information about a time at which compaction work at each compaction position is started (hereinafter referred to as "start determination time"), information about some of the positions of the shovel body of the shovel 100 at the start determination time, information about work content of the shovel 100 at the start determination time, information about work environment at the start determination time, information about the movement of the shovel 100 measured at the start determination time and in a period of time before and after the start determination time, and the like. Further, for example, the work information about the compaction may include at least one of information about a time at which compaction work at each compaction position is completed (hereinafter referred to as "completion determination time"), information about some of the positions of the shovel body of the shovel 100 at the completion determination time, information about work content of the shovel 100 at the completion determination time, information about work environment at the completion determination time, information about the movement of the shovel 100 measured at the completion determination time and in a period of time before and after the completion determination time, and the like. In this case, for example, the information about the work environment may include at least one of information about inclination of the ground, information about weather around the shovel 100, and the like. For example, the information about the movement of the shovel 100 may include at least one of the pilot pressure, the pressures of the hydraulic oil in the hydraulic actuators, and the like.

For example, the work information about the compaction may include at least one of information about a time at which the shovel 100 is determined to be jacked up in a case where the shovel 100 is jacked up (hereinafter referred to as "jack up time"), information about some of the positions of the shovel body at the jack up time, information about work content of the shovel 100 at the jack up time, information about work environment at the jack up time, information about the movement of the shovel 100 measured at the jack up time and in a period of time before and after the jack up time, and the like.

Also, for example, the controller 30 of the shovel 100 may transmit images captured by the image-capturing device S6 to the support device 200 and the like via the communication device T1. For example, the captured images which are to be transmitted include multiple images captured in a predetermined period of time including the start determination time and the completion determination time. The predetermined period of time may include a period of time before the start determination time and a period of time after the completion determination time.

Also, the controller 30 may transmit at least one of information about work content of the shovel 100, information about pose of the shovel 100, information about the pose of the excavation attachment, and the like in the predetermined period of time including the start determination time and the completion determination time to the support device 200, the management device 300, and the like.

Accordingly, managers and the like who use the support device 200, the management device 300, and the like can obtain information about the work site. In other words, managers and the like who use the support device 200, the management device 300, and the like can analyze the progress of the work by the shovel 100, and further, improve the work environment of the shovel 100 on the basis of such analysis result. Therefore, the amount of earth in finishing work after compaction can be appropriately determined by managing the work information about the compaction.

Also, the controller 30 may determine presence or absence of any object entering a predetermined range of the shovel 100 on the basis of output information from the object detection device. In this case, for example, the controller 30 decelerates or stops the shovel 100 in a case where an object such as a person, a building, and the like is detected. Then, the controller 30 may transmit information about the intruding object to the support device 200, the management device 300, and the like through the communication device T1. For example, the information about the intruding object may include at least one of information about the position of the intruding object, information about the time when the intruding object is determined (hereinafter referred to as "intruding object determination time"), information about the positions of some of the shovel body of the shovel 100 at the intruding object determination time, information about work content of the shovel 100 at the intruding object determination time, information about work environment at the intruding object determination time, and information about the movement of the shovel 100 measured at the intruding object determination time and in a period of time before and after the intruding object determination time, and the like.

Therefore, managers and the like who use the support device 200 and the management device 300 can analyze the cause and the like as to why a situation in which the movement of the shovel 100 was required to be decelerated or stopped occurred during work, and further can improve the work environment of the shovel 100 on the basis of such analysis result.

[Second Example of Compaction Support Control]

Next, the Second Example of compaction support control with controller 30 (the machine guidance unit 50) is explained with reference to FIG. 12.

Figure 12:
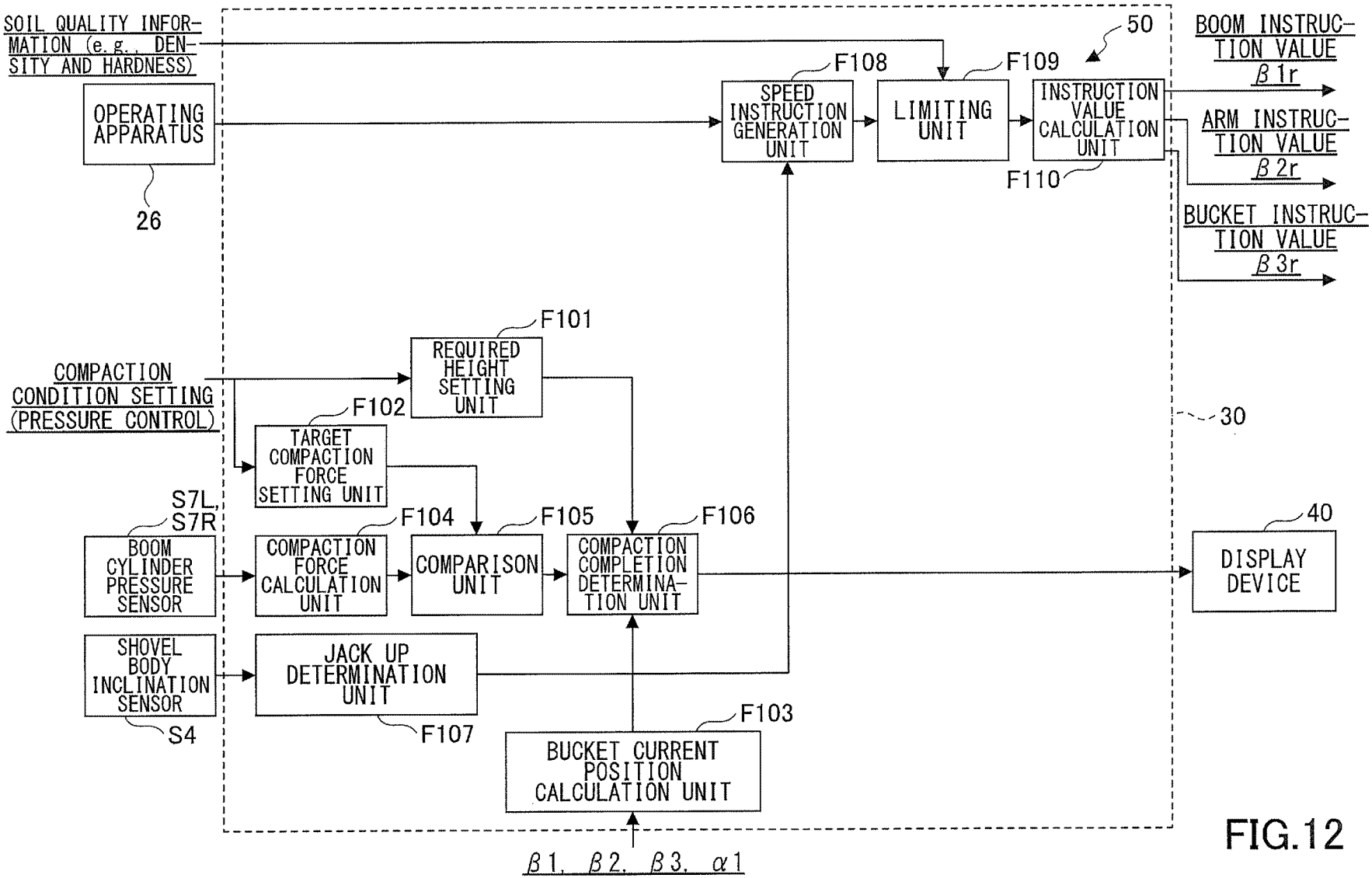
FIG. 12 is a functional block diagram illustrating a Second Example of a functional configuration of compaction support control performed by a controller.

FIG. 12 is a functional block diagram illustrating the Second Example of the functional configuration of the compaction support control performed with the controller 30.

In the explanation about this Example, it is assumed that the operating apparatus 26 is an electric type (see FIG. 10) and outputs an operation signal (electric signal) indicating the operation content of the operating apparatus 26. This is also applicable to the cases of FIGS. 13 to 15 explained below. However, it is to be understood that the operating apparatus 26 may be a hydraulic pilot type (see FIGS. 4A to 4C), and in this case, the controller 30 (the machine guidance unit 50) finds the operation content of the operating apparatus 26 on the basis of detection information of the operation pressure sensor 29.

This Example employs a control scheme for determining compaction completion on the basis of the cylinder pressure of the boom cylinder 7 (i.e., the boom rod pressure and the boom bottom pressure), specifically, on the basis of the compaction force based on the cylinder pressure (hereinafter referred to as "pressure control" for the sake of convenience). For example, the employed control scheme may be designated by a compaction condition that is input from the outside of the controller 30. For example, the compaction condition may be input by an operator with the input device 42, and may be input (received) from an external device (for example, the support device 200 and the management device 300) through the communication device T1. This is also applicable to the cases of FIGS. 13 to 16 explained below.

In this Example, the machine guidance unit 50 of the controller 30 includes a required height setting unit F101, a target compaction force setting unit F102, a bucket current position calculation unit F103, a compaction force calculation unit F104, a comparison unit F105, a compaction completion determination unit F106, a jack up determination unit F107, a speed instruction generation unit F108, a limiting unit F109, and an instruction value calculation unit F110.

The required height setting unit F101 sets a required position reference in the height direction on the ground at the compaction position (hereinafter referred to as "required height") on the basis of the compaction condition that is input from the outside of the controller 30.

The target compaction force setting unit F102 sets the target compaction force on the basis of the compaction condition.

The bucket current position calculation unit F103 calculates the work part of the bucket 6, i.e., the current position of the back surface (hereinafter referred to as "bucket current position") on the basis of detected values of a boom angle β1, an arm angle β2, a bucket angle β3, and a turning angle α1. The boom angle β1, the arm angle β2, the bucket angle β3, and the turning angle α1 are detected by the boom angle sensor S1, the arm angle sensor S2, the bucket angle sensor S3, and the turning state sensor S5.

The compaction force calculation unit F104 calculates (estimates) the compaction force currently applied from the bucket 6 to the ground on the basis of the outputs of the boom bottom pressure sensor S7B and the boom rod pressure sensor S7R.

The comparison unit F105 compares the current compaction force calculated by the compaction force calculation unit F104 with the target compaction force, and determines whether the current compaction force has attained the target compaction force or not. The comparison unit F105 outputs a comparison result to the compaction completion determination unit F106.

The compaction completion determination unit F106 determines whether the compaction work at the current compaction position has been completed or not on the basis of a comparison result of the comparison unit F105, a required height that is set by the required height setting unit F101, and a bucket current position calculated by the bucket current position calculation unit F103.

Specifically, the compaction completion determination unit F106 makes a determination of "compaction work incompletion" (i.e., the compaction work of the current compaction position is incomplete) in a case where the current compaction force has not reached the target compaction force. The compaction completion determination unit F106 makes a determination of "compaction work completion" (i.e., the compaction work at the current compaction position has been completed) in a case where the current compaction force has reached the target compaction force and where the height position at the current compaction position at that time is equal to or more than the required height. The compaction completion determination unit F106 makes a determination of "placing of earth required" (i.e., it is required to place a bank of earth) in a case where the current compaction force has reached the target compaction force and the height at the current compaction position at that time is less than the required height.

The compaction completion determination unit F106 displays the determination result on the display device 40. At that time, in the case of "compaction work incompletion", any particular notification (display) may not be given, and only in the case of "compaction work completion" or "placing of earth required", a notification to that effect may be displayed. Accordingly, the operator can ascertain, e.g., whether the compaction work at the current compaction position has been completed and whether it is required to place a bank of earth. Therefore, in a case where the display device 40 displays that the compaction work is completed, the operator terminates the compaction work at the current compaction position. Then, the operator can operate at least one of the lower traveling body 1, the upper turning body 3, and the attachment, to proceed to the compaction work at a subsequent compaction position (for example, the subsequent compaction position is the compaction position PS2 if the compaction work is currently performed at the compaction position PS1 of FIG. 8). In a case where the display device 40 displays that it is required to place earth, the operator can operate at least one of (the lower traveling body 1), the upper turning body 3, and the attachment to perform work to add earth to the current compaction position.

The jack up determination unit F107 determines whether the shovel 100 is jacked up or not on the basis of the output of the shovel body inclination sensor S4, i.e., the detection information about the inclination angle of the shovel 100. The jack up determination unit F107 outputs the determination result to the speed instruction generation unit F108.

The speed instruction generation unit F108 generates speed instructions of the boom 4, the arm 5, and the bucket 6 on the basis of the operation signal (electric signal) corresponding to the operation content of the operating apparatus 26 and the determination result of the jack up determination unit F107. For example, the speed instruction generation unit F108 generates a speed instruction of the boom 4, which is the master element of driven elements (i.e., the boom 4, the arm 5, and the bucket 6) constituting the attachment, in accordance with the operation content of the operating apparatus 26. The speed instruction generation unit F108 also generates speed instructions of the arm 5 and the bucket 6, which are slave elements, so that the back surface of the bucket 6 comes into contact with compaction position according to the movement of the boom 4, and a relative pose angle of the bucket 6 is maintained at a certain angle with respect to the ground of the compaction target. The speed instruction generation unit F108 also outputs a speed instruction (hereinafter referred to as "deceleration instruction" or "stop instruction") to decelerate or stop the boom 4, the arm 5, and the bucket 6 in a case where the jack up determination unit F107 determines that the shovel 100 is jacked up.

In a case where any given limitation condition for limiting the compaction operation of the shovel 100 (hereinafter referred to as "operation limitation condition") is satisfied, the limiting unit F109 generates a corrected speed instruction in which the speed instruction generated by the speed instruction generation unit F108 is corrected, and outputs the corrected speed instruction to the instruction value calculation unit F110. Conversely, in a case where the operation limitation condition of the shovel 100 is not satisfied, the limiting unit F109 outputs the speed instruction received from the speed instruction generation unit F108 to the instruction value calculation unit F110 without any correction.

For example, the operation limitation condition includes a condition that "the descending speed corresponding to the speed instruction of the boom 4 is more than an upper limit speed based on soil quality information (for example, density, hardness, and the like) received from the outside of the controller 30". For example, the soil quality information may be input by the operator with the input device 42, or may be input (received) from an external device (for example, the support device 200 and the management device 300) through the communication device T1. The soil quality information may be automatically determined on the basis of images of the surroundings of the shovel 100 captured by the image-capturing device S6.

The instruction value calculation unit F110 calculates and outputs instruction values of the pose angles of the boom 4, the arm 5, and the bucket 6 (i.e., the boom angle, the arm angle, and the bucket angle), on the basis of the speed instruction or the corrected speed instruction received from the limiting unit F109. Specifically, the instruction value calculation unit F110 generates and outputs a boom instruction value $\beta 1r$, an arm instruction value $\beta 2r$, and a bucket instruction value $\beta 3r$.

For example, the machine guidance unit 50 controls the electromagnetic valves 60, 62 of the boom cylinder 7 with feedback control so that a deviation between the boom instruction value $\beta 1r$ and the boom angle $\beta 1$ becomes zero. In addition, the machine guidance unit 50 controls the electromagnetic valves 60, 62 of the arm cylinder 8 with feedback control so that a deviation between the arm instruction value $\beta 2r$ and the arm angle $\beta 2$ becomes zero. In addition, the machine guidance unit 50 controls the electromagnetic valves 60, 62 of the bucket 6 with feedback control so that a deviation between the bucket instruction value $\beta 3r$ and the bucket angle $\beta 3$ becomes zero.

As described above, in this Example, with the use of the pressure control, the machine guidance unit 50 automatically controls the operation of the arm 5 and the bucket 6, which are the slave elements, so that the back surface of the bucket 6 comes into contact with the ground of the compaction position at a predetermined angle according to (in synchronization with) the movement of the boom 4, which is the master element, in accordance with the operator's operation. Therefore, the shovel 100 can achieve desired compaction operation in accordance with the operator's operation.

[Third Example of Compaction Support Control]

Next, the Third Example of the compaction support control performed with the controller 30 (the machine guidance unit 50) is explained with reference to FIG. 13.

Figure 13:
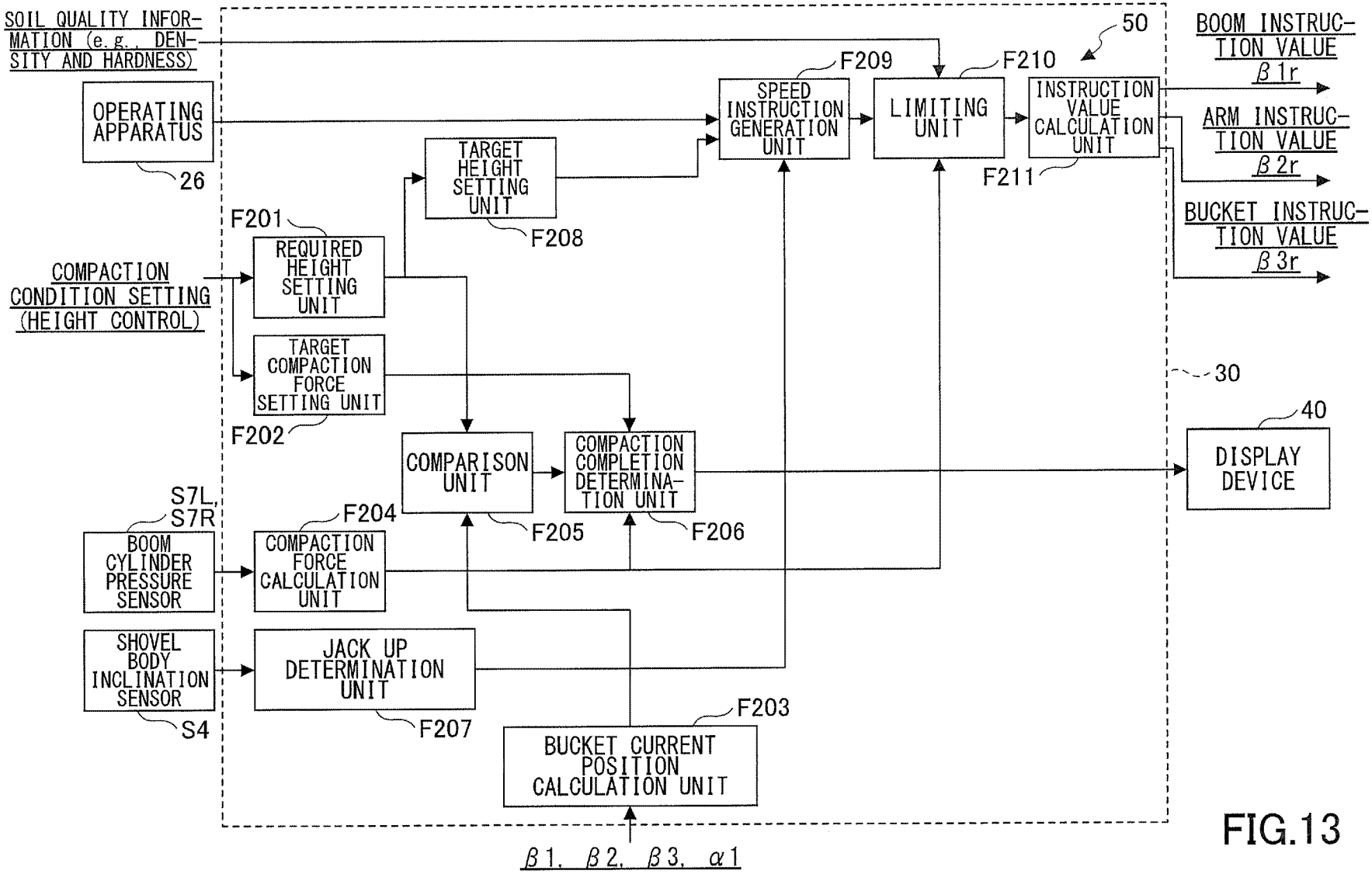
FIG. 13 is a functional block diagram illustrating a Third Example of a functional configuration of compaction support control performed by a controller.

FIG. 13 is a functional block diagram illustrating the Third Example of the functional configuration of the compaction support control performed with the controller 30.

This Example is different from the Second Example in that this Example employs the control scheme (hereinafter referred to as "height control" for the sake of convenience) for determining the cylinder pressure of the boom cylinder 7 (i.e., the boom rod pressure and the boom bottom pressure), specifically, determining compaction completion on the basis of whether the required height is attained.

Hereinafter, features different from the Second Example of FIG. 12 are mainly explained, and explanation about the corresponding features may be omitted or abbreviated.

In this Example, the machine guidance unit 50 of the controller 30 includes a required height setting unit F201, a target compaction force setting unit F202, a bucket current position calculation unit F203, a compaction force calculation unit F204, a comparison unit F205, a compaction completion determination unit F206, a jack up determination unit F207, a target height setting unit F208, a speed instruction generation unit F209, a limiting unit F210, and an instruction value calculation unit F211.

Normally, the compaction work is performed after the earth has been placed. Therefore, in this Example, a difference between the height of the ground before the earth is placed and the height of the ground after the compaction is performed is set as the required height, and in a case where the bucket 6 sinks below the required height as a result of compaction, the compaction is determined to be insufficient. This is also applicable to the Fourth Example of FIG. 14.

The functions of the required height setting unit F201, the target compaction force setting unit F202, the bucket current position calculation unit F203, the compaction force calculation unit F204, the jack up determination unit F207, and the instruction value calculation unit F211 are the same as the required height setting unit F101, the target compaction force setting unit F102, the bucket current position calculation unit F103, the compaction force calculation unit F104, the jack up determination unit F107, and the instruction value calculation unit F110, respectively, of FIG. 12. Therefore, explanation thereabout is omitted.

The comparison unit F205 compares the required height that is set by the required height setting unit F201 and the bucket current position in contact with the ground calculated by the bucket current position calculation unit F203 (i.e., the height position of the ground at the current compaction position). The comparison unit F205 outputs the comparison result to the compaction completion determination unit F206.

The compaction completion determination unit F206 determines whether the compaction work at the current compaction position is completed or not, on the basis of the comparison result of the comparison unit F205, the target compaction force that is set by the target compaction force setting unit F202, and the current compaction force calculated by the compaction force calculation unit F204.

Specifically, the compaction completion determination unit F206 makes a determination of "compaction work incompletion" (i.e., the compaction work at the current compaction position is incomplete) in a case where the height of the ground at the current compaction position has not reached the required height (i.e., the bucket 6 sinks below the required height). The compaction completion determination unit F206 makes a determination of "compaction work completion" (i.e., the compaction work at the current compaction position is completed) in a case where the height of the ground at the current compaction position has reached the required height and the compaction force at that moment is equal to or more than the target compaction force. Also, the compaction completion determination unit F206 makes a determination of "compaction force insufficient" in a case where the height of the ground at the current compaction position has reached the required height and the compaction force at that moment is less than the target compaction force.

The compaction completion determination unit F206 displays the determination result on the display device 40. At that time, in a case of "compaction work incompletion", any particular notification (display) may not be given, and only in the case of "compaction work completion" or "compaction force insufficient", a notification to that effect may be displayed. Accordingly, the operator can find, e.g., whether the compaction work at the current compaction position has been completed, and whether the compaction force is insufficient. Therefore, in a case where the display device 40 displays that the compaction work is completed, the operator terminates the compaction work at the current compaction position. Then, the operator can operate at least one of the lower traveling body 1, the upper turning body 3, and the attachment, to proceed to the compaction work at a subsequent compaction position. In a case where the display device 40 determines that the compaction force is insufficient, the operator can continue the compaction work to eliminate the state in which the compaction force is insufficient and perform work to add earth to the current compaction position by operating at least one of the lower traveling body 1, the upper turning body 3, and the attachment.

The target height setting unit F208 sets the target height during automatic control of the attachment. Specifically, the target height setting unit F208 may set, as the target height, a height position lower than the required height that is set by the required height setting unit F201. In other words, the target height is required to be set at a position at least lower than the position of the compacted ground surface.

The speed instruction generation unit F209 generates the speed instructions of the boom 4, the arm 5, and the bucket 6 on the basis of the operation signal of the operating apparatus 26, the determination result of the jack up determination unit F207, and the target height that is set by the target height setting unit F208. For example, like the Second Example of FIG. 12, the speed instruction generation unit F209 generates a speed instruction of the boom 4, which is the master element, from among the driven elements (i.e., the boom 4, the arm 5, and the bucket 6) constituting the attachment in accordance with the operation content of the operating apparatus 26. The speed instruction generation unit F209 also generates speed instructions of the arm 5 and the bucket 6, which are slave elements, so that the back surface of the bucket 6 comes into contact with compaction position according to the movement of the boom 4, and a relative pose angle of the bucket 6 is maintained at a certain angle with respect to the ground of the compaction target. The speed instruction generation unit F209 also outputs a speed instruction (hereinafter referred to as "deceleration instruction" or "stop instruction") to decelerate or stop the boom 4, the arm 5, and the bucket 6 in a case where the jack up determination unit F207 determines that the shovel 100 is jacked up.

In a case where the operation limitation condition of the shovel 100 is satisfied, the limiting unit F210 generates a corrected speed instruction in which the speed instruction generated by the speed instruction generation unit F209 is corrected, and outputs the corrected speed instruction to the instruction value calculation unit F211. Conversely, in a case where the operation limitation condition of the shovel 100 is not satisfied, the limiting unit F210 outputs the speed instruction received from the speed instruction generation unit F209 to the instruction value calculation unit F211 without any correction.

The operation limitation condition includes not only the condition exemplified in the Second Example of FIG. 12 but also, for example, a condition that "the current compaction force is relatively too high although the current compaction position is less than the required height". In a case where the operation limitation condition is satisfied, the limiting unit F210 may display a notification for prompting the operator to place additional earth on the display device 40.

As described above, in this Example, with the use of the height control, the machine guidance unit 50 automatically controls the operation of the arm 5 and the bucket 6, which are the slave elements, so that the back surface of the bucket 6 comes into contact with the ground of the compaction position at a predetermined angle according to (in synchronization with) the movement of the boom 4, which is the master element. Therefore, the shovel 100 can achieve desired compaction operation in accordance with the operator's operation.

[Fourth Example of Compaction Support Control]

Next, the Fourth Example of the compaction support control performed with the controller 30 (the machine guidance unit 50) is explained with reference to FIG. 14.

Figure 14:
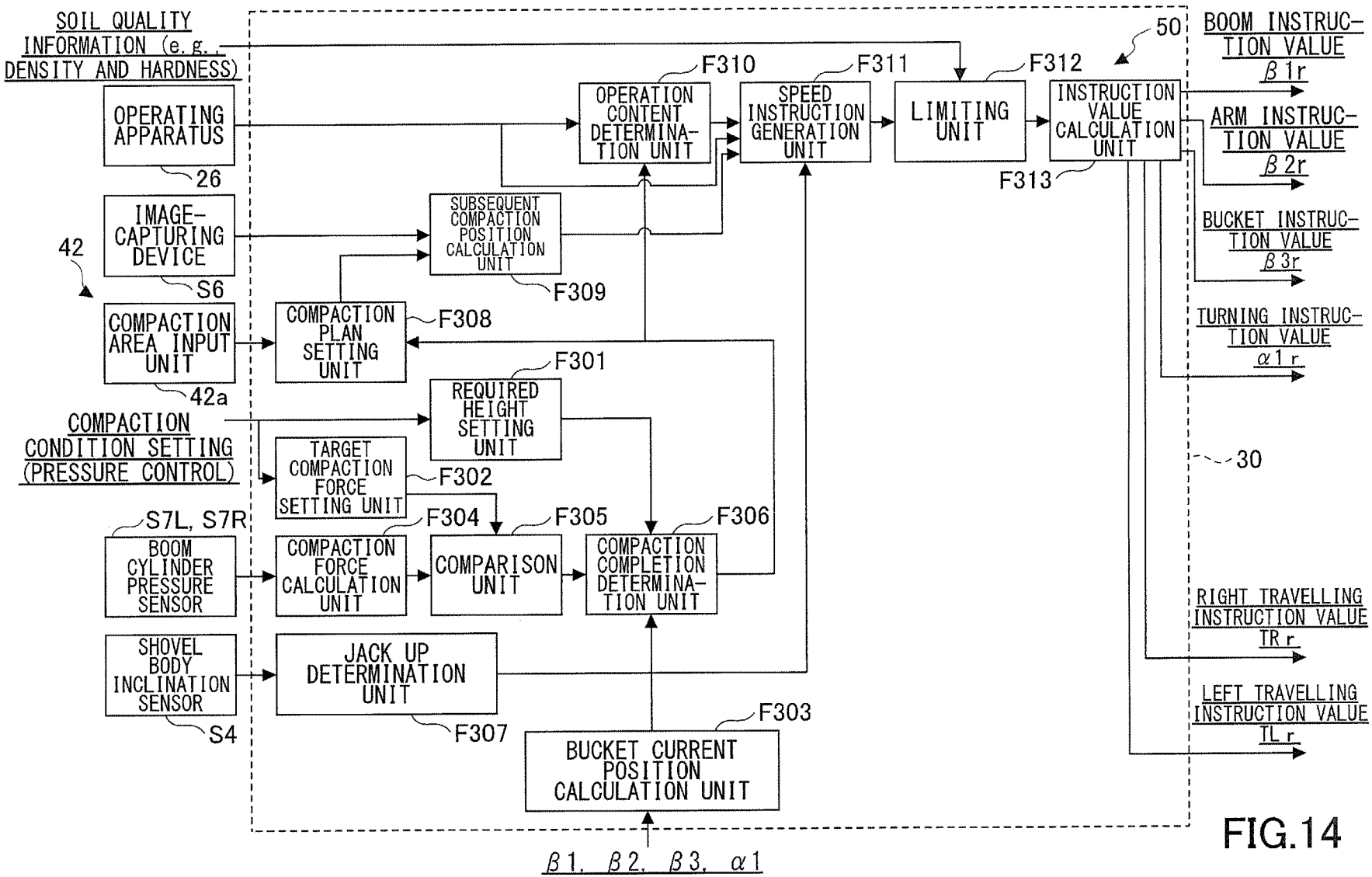
FIG. 14 is a functional block diagram illustrating a Fourth Example of a functional configuration of compaction support control performed by a controller.

FIG. 14 is a functional block diagram illustrating the Fourth Example of the functional configuration of the compaction support control performed with the controller 30.

This Example is similar to the Second Example (FIG. 13) explained above in that the pressure control is employed. This Example is different from the Second Example explained above in that this Example employs a control scheme (hereinafter referred to as "autonomous movement control") in which, in a case where the compaction work at the current compaction position is completed and travelling movement and turning movement to a subsequent compaction position are required, the lower traveling body 1 and the upper turning body 3 are autonomously operated to automatically move the shovel 100 to the subsequent compaction position.

Hereinafter, features different from the Second Example of FIG. 12 are mainly explained, and explanation about the corresponding features may be omitted or abbreviated.

In this Example, the machine guidance unit 50 of the controller 30 includes a required height setting unit F301, a target compaction force setting unit F302, a bucket current position calculation unit F303, a compaction force calculation unit F304, a comparison unit F305, a compaction completion determination unit F306, a jack up determination unit F307, a compaction plan setting unit F308, a subsequent compaction position calculation unit F309, an operation content determination unit F310, a speed instruction generation unit F311, a limiting unit F312, and an instruction value calculation unit F313.

The functions of the required height setting unit F301, the target compaction force setting unit F302, the bucket current position calculation unit F303, the compaction force calculation unit F304, the comparison unit F305, the compaction completion determination unit F306, and the jack up determination unit F307 are the same as the required height setting unit F101, the target compaction force setting unit F102, the bucket current position calculation unit F103, the compaction force calculation unit F104, the comparison unit F105, the compaction completion determination unit F106, and the jack up determination unit F107, respectively, of FIG. 12. Therefore, explanation thereabout is omitted.

The compaction plan setting unit F308 sets a plan of the compaction work of the shovel 100 on the basis of information about a target area of compaction work received from a compaction area input unit 42*a* included in the input device 42 (hereinafter referred to as "compaction area"). For example, the compaction area input unit 42*a* may receive an operation input from the operator, who operates a predetermined input screen (GUI, Graphical User Interface) for inputting a compaction area displayed on the display device 40, and input information about the compaction area based on the operator's operation. Also, the information about the compaction area may be input from a predetermined external device (for example, the support device 200 and the management device 300) through the communication device T1.

In a case where the compaction completion determination unit F306 determines that the compaction work at the current compaction position is completed, the subsequent compaction position calculation unit F309 calculates a subsequent compaction position (hereinafter referred to as "subsequent compaction position") on the basis of images captured by the image-capturing device S6 and the plan of the compaction work in the entire compaction area that is set by the compaction plan setting unit F308.

The operation content determination unit F310 determines the operation content to be performed by the shovel 100 on the basis of the operation content of the operating apparatus 26 and the determination result of the compaction completion determination unit F306.

Specifically, in a case where the compaction completion determination unit F306 makes a determination of "compaction work incompletion", the operation content determination unit F310 determines that the operation content to be performed by the shovel 100 is the compaction operation at the current compaction position. In a case where the compaction completion determination unit F306 makes a determination of "placing of earth required", the operation content determination unit F310 determines that the operation to be performed by the shovel 100 is an earth-placing operation. In this case, for example, the earth-placing operation may be achieved by a combination of a boom raising turning operation, an earth loading operation to the bucket 6, a boom lowering turning operation, and an earth unloading operation from the bucket 6. In a case where the compaction completion determination unit F306 makes a determination of "compaction work completion", the operation content determination unit F310 further determines whether the shovel 100 is required to make movement (at least one of travelling movement and turning movement) to perform the compaction work at a subsequent compaction position. In a case where the shovel 100 is required to make a movement to perform the compaction operation at a subsequent compaction position, the operation content determination unit F310 determines that the operation content to be performed by the shovel 100 is a movement operation. In a case where any movement is not required to perform the compaction work at a subsequent compaction position (for example, the target of the compaction work of FIG. 8 transitions from the compaction position PS1 to the compaction position PS2), the operation content determination unit F310 determines that the operation content to be performed by the shovel 100 is the compaction operation at the subsequent compaction position.

The speed instruction generation unit F311 outputs a speed instruction on at least one of the right side crawler and the left side crawler of the lower traveling body 1, the upper turning body 3, the boom 4, the arm 5, and the bucket 6, on the basis of the determination result of the operation content determination unit F310, the operation content of the operating apparatus 26, and the calculation result (i.e., subsequent compaction position) of the subsequent compaction position calculation unit F309.

Specifically, in a case where the operation content determination unit F310 determines that the operation content of the shovel 100 is the compaction operation at the current compaction position or the compaction operation at a subsequent compaction position, the speed instruction generation unit F311 may output the speed instructions of the boom 4, the arm 5, and the bucket 6 similar to the Second Example of FIG. 12 for the current compaction position or the subsequent compaction position in accordance with the operation content of the operating apparatus 26.

Also, in a case where the operation content determination unit F310 determines that the operation content of the shovel 100 is an earth-placing operation, the speed instruction generation unit F311 may output the speed instruction of at least one of (the lower traveling body 1), the upper turning body 3, the boom 4, the arm 5, and the bucket 6 corresponding to any one of a boom raising turning operation, an earth loading operation, a boom lowering turning operation, and an earth unloading operation, according to the operation content of the operating apparatus 26 or without depending on the operation content of the operating apparatus 26.

In a case where the operation content determination unit F310 determines that the operation content of the shovel 100 is a movement operation, the speed instruction generation unit F311 may output a speed instruction for the lower traveling body 1 and the upper turning body 3 corresponding to at least one of autonomous travelling movement and turning movement to the subsequent compaction position, according to the operation content of the operating apparatus 26 or without depending on the operation content of the operating apparatus 26.

In a case where the operation limitation condition of the shovel 100 is satisfied, the limiting unit F312 generates a corrected speed instruction in which the speed instruction generated by the speed instruction generation unit F311 is corrected, and outputs the corrected speed instruction to the instruction value calculation unit F313. Conversely, in a case where the operation limitation condition of the shovel 100 is not satisfied, the limiting unit F312 outputs the speed instruction received from the speed instruction generation unit F311 to the instruction value calculation unit F313 without any correction.

In a case where the speed instruction of the speed instruction generation unit F311 corresponds to the compaction operation of the shovel 100, for example, like the Second Example of FIG. 12 and the like, the operation limitation condition may include a condition based on soil quality information. Also, the operation limitation condition may include, for example, a condition that "a predetermined object does not exist in an area relatively in proximity to the surroundings of the shovel 100" in which the speed instruction of the speed instruction generation unit F311 corresponds to the movement operation of the shovel 100. Examples of predetermined objects include people, other work machines, telephone poles, traffic cones, and the like. This is because the shovel 100 is prevented from coming into contact with objects in the surroundings of the shovel 100 as a result of travelling movement and turning movement of the shovel 100.

The instruction value calculation unit F313 calculates and outputs instruction values of pose angles for the boom 4, the arm 5, the bucket 6, the upper turning body 3, the right side crawler, and the left side crawler, on the basis of the speed instruction or the corrected speed instruction received from the limiting unit F312. Specifically, the instruction value calculation unit F313 generates and outputs the boom instruction value $\beta 1r$, the arm instruction value $\beta 2r$, the bucket instruction value $\beta 3r$, the turning instruction value $\alpha 1r$, the right travelling instruction value TRr, and the left travelling instruction value TLr.

As described above, in this Example, the machine guidance unit 50 achieves autonomous compaction work in accordance with the operator's operation with the use of the pressure control, and when compaction work at a certain compaction position is finished, the shovel 100 is autonomously moved to a subsequent compaction position, and the compaction work at a subsequent compaction position can be started. Therefore, the machine guidance unit 50 can cause the shovel 100 to semi-automatically execute compaction work in a predetermined compaction area according to a predetermined plan. Therefore, the compaction work can be performed more efficiently by the shovel 100.

[Fifth Example of Compaction Support Control]

Next, the Fifth Example of the compaction support control performed with the controller 30 (the machine guidance unit 50) is explained with reference to FIG. 15.

Figure 15:
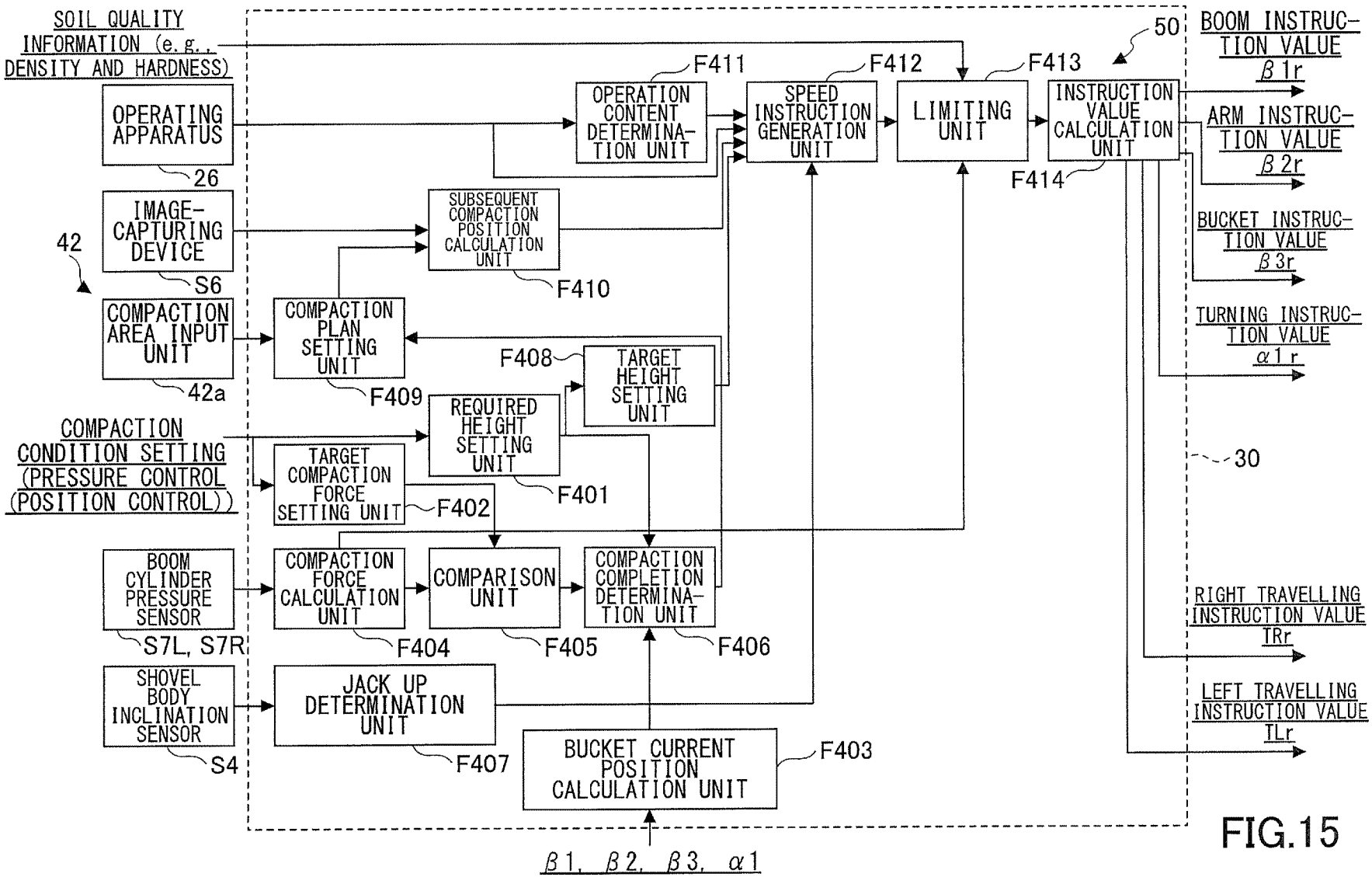
FIG. 15 is a functional block diagram illustrating a Fifth Example of a functional configuration of compaction support control performed by a controller.

FIG. 15 is a functional block diagram illustrating the Fifth Example of the functional configuration of the compaction support control performed with the controller 30.

This Example is similar to the Third Example (FIG. 13) explained above in that the height control is employed. This Example is different from the Third Example explained above and is similar to the Fourth Example (FIG. 14) explained above in that the autonomous movement control is employed.

Hereinafter, features different from the Third Example of FIG. 13 and the Fourth Example are mainly explained, and explanation about the corresponding features may be omitted or abbreviated.

In this Example, the machine guidance unit 50 of the controller 30 includes a required height setting unit F401, a target compaction force setting unit F402, a bucket current position calculation unit F403, a compaction force calculation unit F404, a comparison unit F405, a compaction completion determination unit F406, a jack up determination unit F407, a target height setting unit F408, a compaction plan setting unit F409, a subsequent compaction position calculation unit F410, an operation content determination unit F411, a speed instruction generation unit F412, a limiting unit F413, and an instruction value calculation unit F414.

The functions of the required height setting unit F401, the target compaction force setting unit F402, the bucket current position calculation unit F403, the compaction force calculation unit F404, the comparison unit F405, the compaction completion determination unit F406, the jack up determination unit F407, and the target height setting unit F408 are the same as the required height setting unit F201, the target compaction force setting unit F202, the bucket current position calculation unit F203, the compaction force calculation unit F204, comparison unit F205, the compaction completion determination unit F206, the jack up determination unit F207, and the target height setting unit F208, respectively, of FIG. 13, and explanation about the corresponding features may be omitted or abbreviated. Also, the functions of the compaction plan setting unit F409, the subsequent compaction position calculation unit F410, the speed instruction generation unit F412, the limiting unit F413, and the instruction value calculation unit F414 are the same as the compaction plan setting unit F308, the subsequent compaction position calculation unit F309, the speed instruction generation unit F311, the limiting unit F312, and the instruction value calculation unit F313, respectively, of FIG. 14, and explanation about the corresponding features may be omitted or abbreviated.

The operation content determination unit F411 determines the operation content to be performed by the shovel 100 on the basis of the operation content of the operating apparatus 26 and the determination result of the compaction completion determination unit F306.

Specifically, in a case where the compaction completion determination unit F406 makes a determination of "placing of earth required", the operation content determination unit F411 determines that the operation to be performed by the shovel 100 is an earth-placing operation. In a case where the compaction completion determination unit F406 makes a determination of "compaction force insufficient", the operation content determination unit F411 may determine that the operation to be performed by the shovel 100 is continuation of compaction operation. Also, in a case where the determination result of the compaction completion determination unit F406 is "compaction force insufficient", the operation content determination unit F411 may determine whether the operation to be performed by the shovel 100 is an earth-placing operation or continuation of a compaction operation in view of the degree of insufficient compaction force. Also, in a case where the compaction completion determination unit F406 makes a determination of "compaction work incompletion" or makes a determination of "compaction work completion", the operation content determination unit F411 may perform determination processing similar to the Fourth Example (FIG. 14) explained above.

As described above, in this Example, the machine guidance unit 50 achieves autonomous compaction work in accordance with the operator's operation with the use of the height control, and when compaction work at a certain compaction position is finished, the shovel 100 is autonomously moved to a subsequent compaction position, and the compaction work at a subsequent compaction position can be started. Therefore, the machine guidance unit 50 can cause the shovel 100 to semi-automatically execute compaction work in a predetermined compaction area according to a predetermined plan. Therefore, the compaction work can be performed more efficiently by the shovel 100.

[Sixth Example of Compaction Support Control]

Next, the Sixth Example of the compaction support control performed with the controller 30 (the machine guidance unit 50) is explained with reference to FIG. 16.

Figure 16:
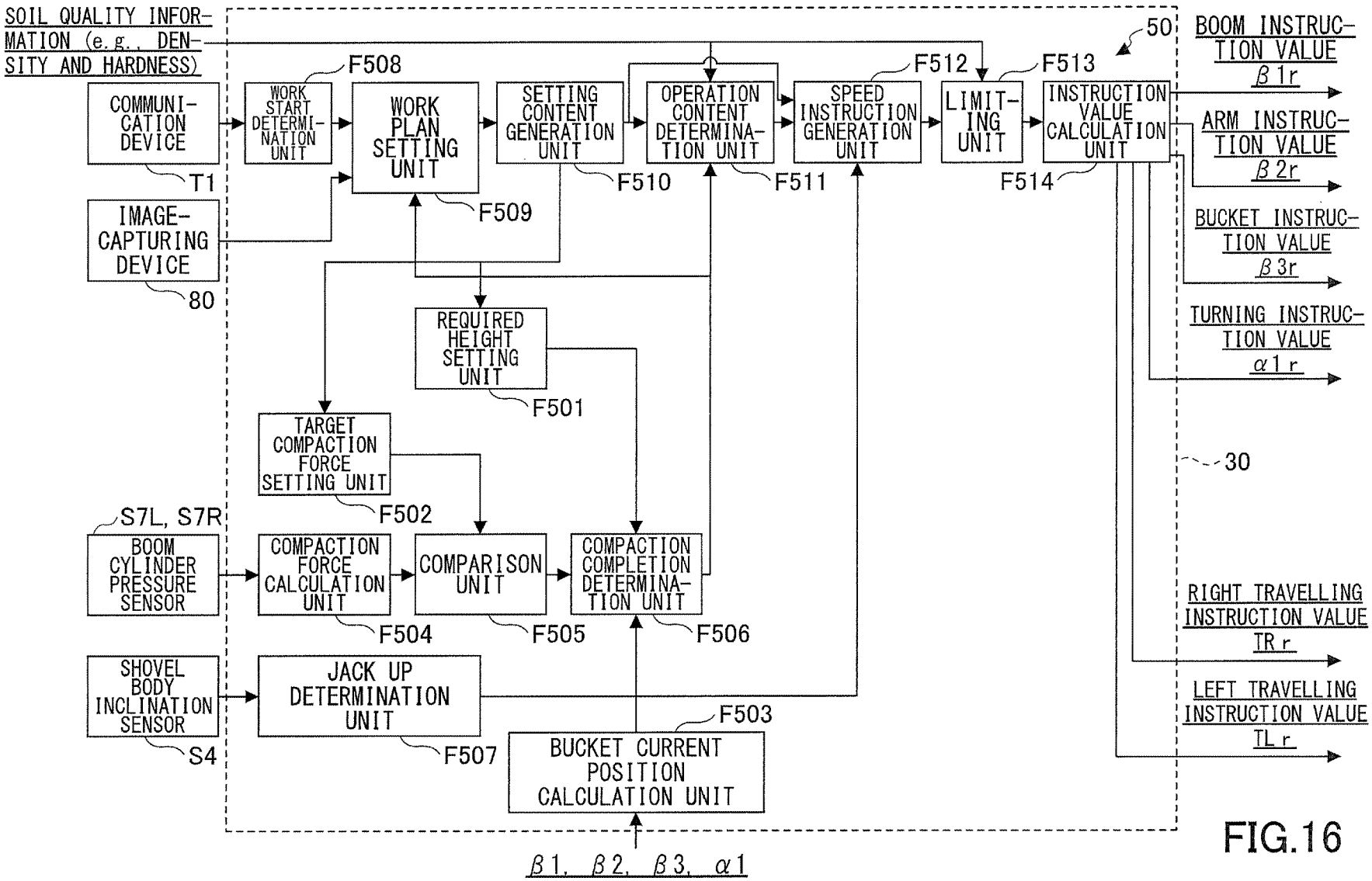
FIG. 16 is a functional block diagram illustrating a Sixth Example of a functional configuration of compaction support control performed by a controller.

FIG. 16 is a functional block diagram illustrating the Sixth Example of the functional configuration of the compaction support control performed with the controller 30.

This Example is similar to the Second Example (FIG. 12) explained above and Fourth Example (FIG. 14) in that the pressure control is employed. This Example is different from the Second Example and the Fourth Example in that this Example employs a control scheme (hereinafter referred to as "autonomous compaction control") in which the shovel 100 autonomously performs compaction work of the entire predetermined compaction area including movement by remote operation with an external device (for example, the support device 200 and the management device 300).

Hereinafter, features different from the Second Example and the Fourth Example of FIG. 14 are mainly explained, and explanation about the corresponding features may be omitted or abbreviated.

In this Example, the machine guidance unit 50 of the controller 30 includes a required height setting unit F501, a target compaction force setting unit F502, a bucket current position calculation unit F503, a compaction force calculation unit F504, a comparison unit F505, a compaction completion determination unit F506, a jack up determination unit F507, a work start determination unit F508, a work plan setting unit F509, a setting content generation unit F510, an operation content determination unit F511, a speed instruction generation unit F512, a limiting unit F513, and an instruction value calculation unit F514.

The functions of the bucket current position calculation unit F503, the compaction force calculation unit F504, the comparison unit F505, the compaction completion determination unit F506, the jack up determination unit F507, the operation content determination unit F511, the limiting unit F513, and the instruction value calculation unit F514 are the same as the bucket current position calculation unit F303, the compaction force calculation unit F304, the comparison unit F305, the compaction completion determination unit F306, the jack up determination unit F307, the operation content determination unit F310, the limiting unit F312, and the instruction value calculation unit F313, respectively, of FIG. 14, and explanation thereabout is omitted.

The required height setting unit F501 and target compaction force setting unit F502 set the required height and the target compaction force, respectively on the basis of the compaction condition generated automatically by the setting content generation unit F510.

The work start determination unit F508 determines whether compaction work is started, in accordance with an instruction of remote operation (hereinafter referred to as "remote operation instruction") received from a predetermined external device (for example, the support device 200 and the management device 300) through the communication device F1.

In a case where the work start determination unit F508 determines that compaction work is started, the work plan setting unit F509 sets a plan of the compaction work of the shovel 100 in accordance with the images captured by the image-capturing device S6 and the information about the compaction area designated in the remote operation instruction.

The setting content generation unit F510 automatically (autonomously) generates content of various kinds of settings of compaction work, on the basis of a content that is set by a remote operation instruction and information about the plan of the compaction work that is set by the work plan setting unit F509. For example, the setting content generation unit F510 generates compaction conditions (i.e., the required height and the target compaction force) on the basis of a content that is set by the remote operation instruction and the information about the plan of compaction work that is set by the work plan setting unit F509. For example, the setting content generation unit F510 sets a subsequent compaction position for the case where the compaction work at the current compaction position is completed, on the basis of the information about the plan of the compaction work that is set by the work plan setting unit F509.

The speed instruction generation unit F512 outputs a speed instruction for at least one of the right side crawler and the left side crawler of the lower traveling body 1, the upper turning body 3, the boom 4, the arm 5, and the bucket 6, on the basis of the setting content (for example, the subsequent compaction position) generated by the setting content generation unit F510 and the determination result of the operation content determination unit F511.

Specifically, in a case where the operation content determination unit F310 determines that the operation content of the shovel 100 is the compaction operation at the current compaction position or the compaction operation at the subsequent compaction position, the speed instructions of the boom 4, the arm 5, and the bucket 6 required for pressing the back surface of the bucket 6 to the current compaction position or the subsequent compaction position may be autonomously generated and output.

In a case where the operation content determination unit F511 determines that the operation content of the shovel 100 is an earth-placing operation, the speed instruction generation unit F512 may autonomously generate and output a speed instruction for at least one of (the lower traveling body 1), the upper turning body 3, the boom 4, the arm 5, and the bucket 6 corresponding to any one of a boom raising turning operation, an earth loading operation, a boom lowering turning operation, and an earth unloading operation.

In a case where the operation content determination unit F511 determines that the operation content of the shovel 100 is a movement operation, the speed instruction generation unit F512 may autonomously generate and output speed instructions of the lower traveling body 1 and the upper turning body 3 corresponding to at least one of autonomous travelling movement and turning movement to the subsequent compaction position.

As described above, in this Example, the machine guidance unit 50 can determine the start of the compaction work of the shovel 100 in accordance with an instruction of remote operation from the outside of the shovel 100 with the use of the pressure control, and autonomously perform autonomous compaction work and movement operation between compaction positions. Therefore, the machine guidance unit 50 can cause the shovel 100 to fully automatically, i.e., autonomously, execute compaction work in a predetermined compaction area according to a predetermined plan. Therefore, the compaction work can be performed more efficiently by the shovel 100.

The controller 30 may record a portion where earth is placed more than necessary in a predetermined storage unit (for example, an internal auxiliary storage device) on the basis of height information after the compaction. Specifically, the controller 30 may record position information about a location of jack up (for example, a latitude, a longitude, and the like). The controller 30 (the machine guidance unit 50) may generate a target excavation path to attain a predetermined height at the location of jack up, and automatically control the boom 4, the arm 5, and the bucket 6 (i.e., the attachment), so that the teeth end of the bucket 6 moves along the target excavation path. Accordingly, the shovel 100 can realize more accurately compacted terrain.

The controller 30 may record position information (a latitude, a longitude, and the like) about a location exceeding the allowable height in a predetermined storage unit. In this case, the controller 30 (the machine guidance unit 50) generates a target excavation path so that the predetermined height is attained in a portion exceeding the allowable height, and controls the boom 4, the arm 5, and the bucket 6 (i.e., the attachment) so that the teeth end of the bucket 6 moves along the target excavation path. Accordingly, the shovel 100 can realize more accurately compacted terrain.

In such a case, the shovel 100 may perform excavation work based on a target excavation path upon switching a work mode for performing compaction work to a work mode for performing excavation work under the control of the machine guidance unit 50 (the work plan setting unit F509).

Although this Example employs the pressure control, this Example may also employ the height control similar to the Third Example (FIG. 13) and the Fifth Example (FIG. 15) explained above.

According to the above embodiment, a shovel capable of finishing the ground with a higher accuracy in compaction work can be provided.

Although the embodiment for carrying out the present invention has been hereinabove explained in detail, the present invention is not limited to the particular embodiment as described above, and various modifications and changes can be made within the gist of the present invention described in the claims.

For example, in the embodiment explained above, the shovel 100 is configured to hydraulically drive all of various kinds of operation elements such as the lower traveling body 1, the upper turning body 3, the boom 4, the arm 5, the bucket 6, and the like. However, some of them may be configured to be electrically driven. In other words, the configuration and the like disclosed in the above embodiment may be applied to a hybrid shovel, an electric shovel, and the like.

What is claimed is:

1. A shovel comprising:

a lower traveling body;

an upper turning body turnably mounted on the lower traveling body;

a boom attached to the upper turning body;

an arm attached to the boom;

an end attachment attached to the arm;

a boom cylinder configured to drive the boom;

an arm cylinder configured to drive the arm;

an end attachment cylinder configured to drive the end attachment;

a sensor configured to output detection information about an orientation of a work part of the end attachment; and a processor configured to control operation of the work part to cause the work part to perform compaction of ground by pressing the work part against the ground, wherein the processor is configured to automatically extend or retract the arm cylinder and the end attachment cylinder according to a lowering operation of the boom performed with an operating apparatus by an operator to cause an end portion of the work part to perform the compaction of the ground on the basis of the detection information of the sensor.

2. The shovel according to claim 1, wherein the processor is configured to automatically extend or retract the arm cylinder and the end attachment cylinder according to the lowering operation of the boom to maintain the work part in a predetermined pose relative to an excavation target surface, and perform the compaction of the ground by pressing the work part maintained in the predetermined pose against the excavation target surface.

3. The shovel according to claim 1, wherein the processor is configured to output, through a display or a sound output device, a notification to prompt the operator to carry out the compaction with the work part, upon detecting that a thickness of a bank of earth placed by the end attachment becomes equal to or more than a predetermined thickness.

4. The shovel according to claim 1, wherein the processor is configured to output, through a display or a sound output device, a notification to prompt the operator to transition to predetermined subsequent work, upon completion of the compaction with the work part in a predetermined area.

5. The shovel according to claim 1, wherein the processor is configured to cause the work part to perform the compaction on a portion where a thickness of a bank of earth placed by the end attachment is equal to or more than a predetermined thickness.

6. The shovel according to claim 1, wherein the processor is configured to move the end attachment to a subsequent compaction position, upon completion of the compaction with the work part at a current compaction position.

7. The shovel according to claim 1, wherein the processor is configured to determine that the compaction is completed upon detecting that a height of the ground at a compaction position reaches a required height and a compaction force is equal to or more than a target compaction force.

8. The shovel according to claim 7, further comprising:

a boom bottom pressure sensor; and a boom rod pressure sensor, wherein the processor is configured to calculate the compaction force on the basis of outputs of the boom bottom pressure sensor and the boom rod pressure sensor.

9. The shovel according to claim 7, wherein the processor is configured to obtain information about a position of the ground after the compaction is completed.

10. The shovel according to claim 1, wherein the processor is configured to place earth to form a bank of earth having a thickness equal to or more than a predetermined thickness.

11. The shovel according to claim 1, wherein the processor is configured to set a plurality of layers as excavation target surfaces at a compaction position.

12. The shovel according to claim 11, wherein the processor is configured to set a target height for each of the plurality of layers.

13. The shovel according to claim 12, wherein the processor is configured to determine whether the compaction is completed with respect to the target height.

14. A shovel comprising:

a lower traveling body;

an upper turning body turnably mounted on the lower traveling body;

a boom attached to the upper turning body;

an arm attached to the boom;

an end attachment attached to the arm;

a sensor configured to output detection information about an orientation of a work part of the end attachment; and a processor configured to control operation of the work part to cause the work part to perform compaction of ground by pressing the work part against the ground, wherein the processor is configured to place a bank of earth with the end attachment, and output, through a display or a sound output device, a notification to prompt an operator to carry out the compaction with the work part, upon detecting that a thickness of the bank of earth placed with the end attachment becomes equal to or more than a predetermined thickness as a result of said placing the bank of earth with the end attachment.

15. The shovel according to claim 14, wherein the processor is configured to obtain information about a position of the ground after the compaction is completed.

16. The shovel according to claim 14, wherein the processor is configured to place the bank of earth with the end attachment in an area of the ground pre-defined as a target area of the compaction.

17. The shovel according to claim 16, wherein the processor is configured to output the notification to prompt the operator to switch from placing the bank of earth to the compaction work upon detecting that the thickness of the bank of earth placed by the end attachment becomes equal to or more than the predetermined thickness during the placing of the bank of earth.

* * * * *